US009640018B2

(12) United States Patent
Finocchio et al.

(10) Patent No.: US 9,640,018 B2
(45) Date of Patent: May 2, 2017

(54) HYBRID INSTANT ONLINE LOTTERY GAME

(75) Inventors: Richard Finocchio, Everett, MA (US); Andrew Patrick Gray, West Yorkshire (GB); Brian J. Roberts, Charlotte, NC (US)

(73) Assignee: IGT RHODE ISLAND LLC, West Greenwich, RI (US)

( * ) Notice: Subject to any disclaimer, the term of this patent is extended or adjusted under 35 U.S.C. 154(b) by 2243 days.

(21) Appl. No.: 11/432,885

(22) Filed: May 11, 2006

(65) Prior Publication Data

US 2006/0258433 A1 Nov. 16, 2006

Related U.S. Application Data

(60) Provisional application No. 60/680,607, filed on May 12, 2005.

(51) Int. Cl.

| | |
|---|---|
| ***A63F 9/24*** | (2006.01) |
| ***G07F 17/32*** | (2006.01) |
| ***A63F 3/06*** | (2006.01) |

(52) U.S. Cl.

CPC ..... *G07F 17/32* (2013.01); *A63F 3/062* (2013.01); *G07F 17/329* (2013.01); *A63F 3/0625* (2013.01)

(58) Field of Classification Search

USPC ..... 463/16, 17, 20, 42, 21

See application file for complete search history.

(56) References Cited

U.S. PATENT DOCUMENTS 4,882,473 A 11/1989 Bergeron et al.
4,953,895 A * 9/1990 Goussios ..... 283/102
(Continued)

FOREIGN PATENT DOCUMENTS

JP 6-103436 4/1994
JP 2000 126436 5/2000
(Continued)

OTHER PUBLICATIONS

International Search Report dated Sep. 12, 2006, Application No. PCT/US2006/018508, filed May 11,2006.
(Continued)

*Primary Examiner* — Paul A D'Agostino
*Assistant Examiner* — Brandon Gray
(74) *Attorney, Agent, or Firm* — Sage Patent Group

(57) ABSTRACT

A system and method for conducting a lottery game is described. The game may include providing a player with a free pre-printed first game piece having a first set of game play data, wherein game play data on the first game piece is insufficient to ascertain an outcome of the lottery game. The game may further include receiving information identifying the first game piece and an indication the player wishes to purchase a chance in the lottery game. Responsive to receiving the indication, the game outcome may be determined and a second set of game play data chosen based on the outcome, so that a comparison of the first set of game play data and the second set game play data is indicative of the outcome of the chance according to predetermined game rules. The second set of game data may be provided to the player on a second game piece also having data associating the second game piece with the first game piece and a unique identifier. When a claim for a prize is received from the player, the uniquue identifier may be used to confirm whether a prize is due the player. A prize with a value that depends on the game outcome may then be awarded to the player.

55 Claims, 15 Drawing Sheets

(56) References Cited

U.S. PATENT DOCUMENTS

| | | | | |
|---|---|---|---|---|
| 5,080,364 | A | 1/1992 | Seidman | |
| 5,091,634 | A | 2/1992 | Finch et al. | |
| 5,223,698 | A | 6/1993 | Kapur | |
| 5,628,684 | A | 5/1997 | Bouedec | |
| 5,772,510 | A | 6/1998 | Roberts | |
| 5,791,990 | A | 8/1998 | Schroeder et al. | |
| 5,935,000 | A | 8/1999 | Sanchez, III et al. | |
| 6,134,309 | A | 10/2000 | Carson | |
| 6,241,606 | B1 | 6/2001 | Riendeau et al. | |
| 6,530,842 | B1 * | 3/2003 | Wells et al. | 463/46 |
| 6,663,105 | B1 | 12/2003 | Sullivan et al. | |
| 6,695,699 | B2 * | 2/2004 | Beaulieu | 463/25 |
| 6,714,838 | B2 | 3/2004 | Scrymgeour et al. | |
| 6,733,387 | B2 | 5/2004 | Walker et al. | |
| 6,824,464 | B2 | 11/2004 | Weil et al. | |
| 6,899,621 | B2 | 5/2005 | Behm et al. | |
| 6,991,541 | B2 | 1/2006 | Lind et al. | |
| 7,052,393 | B1 | 5/2006 | Schoen | |
| 7,066,382 | B2 | 6/2006 | Kaplan | |
| 7,168,616 | B2 | 1/2007 | Carnation | |
| 2001/0039511 | A1 | 11/2001 | Duckworth et al. | |
| 2002/0055881 | A1 | 5/2002 | Han | |
| 2003/0162580 | A1 | 8/2003 | Cousineau et al. | |
| 2003/0173739 | A1 | 9/2003 | Stewart | |
| 2003/0216164 | A1 | 11/2003 | Scrymgeour | |
| 2004/0002371 | A1 | 1/2004 | Paquin et al. | |
| 2004/0063494 | A1 | 4/2004 | Oran et al. | |
| 2004/0166919 | A1 * | 8/2004 | Duhamel et al. | 463/17 |
| 2004/0176154 | A1 | 9/2004 | Finnochio | |
| 2004/0176158 | A1 * | 9/2004 | Baldwin | 463/17 |
| 2004/0229677 | A1 | 11/2004 | Gray et al. | |
| 2004/0254007 | A1 * | 12/2004 | Reep | 463/17 |
| 2005/0049027 | A1 | 3/2005 | Weiss | |
| 2005/0059465 | A1 * | 3/2005 | Bozeman | 463/18 |
| 2005/0085293 | A1 | 4/2005 | Lindo | |
| 2005/0092839 | A1 | 5/2005 | Oram | |
| 2005/0107152 | A1 | 5/2005 | McGee et al. | |
| 2005/0108127 | A1 | 5/2005 | Brown et al. | |
| 2005/0130736 | A1 | 6/2005 | Polak et al. | |
| 2005/0140092 | A1 | 6/2005 | Solano | |
| 2005/0149393 | A1 * | 7/2005 | Leof | 705/14 |
| 2005/0164770 | A1 | 7/2005 | Wright | |
| 2005/0176490 | A1 | 8/2005 | Wright | |
| 2005/0181858 | A1 | 8/2005 | Caro et al. | |
| 2005/0194735 | A1 | 9/2005 | Mirandette et al. | |
| 2005/0202865 | A1 | 9/2005 | Kim | |
| 2005/0233797 | A1 | 10/2005 | Gilmore et al. | |
| 2005/0255905 | A1 | 11/2005 | Duke et al. | |
| 2005/0282611 | A1 | 12/2005 | Wright | |
| 2006/0014578 | A1 | 1/2006 | Lovell | |
| 2006/0025197 | A1 | 2/2006 | Kane et al. | |
| 2006/0040726 | A1 | 2/2006 | Szrek et al. | |
| 2006/0043669 | A1 | 3/2006 | Gumina | |
| 2006/0052153 | A1 | 3/2006 | Vlazny et al. | |
| 2006/0054695 | A1 | 3/2006 | Owada | |
| 2006/0079311 | A1 | 4/2006 | Nulph | |
| 2006/0100008 | A1 | 5/2006 | Wright et al. | |
| 2006/0160602 | A1 * | 7/2006 | Blythe et al. | 463/17 |
| 2006/0163346 | A1 | 7/2006 | Lee et al. | |
| 2006/0166729 | A1 | 7/2006 | Saffari et al. | |
| 2006/0293783 | A1 | 12/2006 | Hand et al. | |
| 2007/0010311 | A1 | 1/2007 | Irwin, Jr. et al. | |

FOREIGN PATENT DOCUMENTS

| | | |
|---|---|---|
| JP | 2006 218823 | 8/2006 |
| WO | 03/022380 | 3/2003 |

OTHER PUBLICATIONS

"Rules for Draw-Based Games Played at Retailers or by Subscription", http://www.national-lottery.co.uk/player/information.do?info=playlottorules, the National Lottery, 10th Edition, Feb. 28, 2005.

Claire E. House, "Colorado's lottery tickets go online—at checkout counter", http://www.gen.com/state/vol5_no8/news/407-1.html.

"Buy Lottery tickets with SMS with WagerPhone", http://theponderingprimate.blogspot.com/2006/12/buy-lottery-tickets-with-sms-with.html, Dec. 6, 2006.

"Gaming", http://www.zebra.com/id/zebra/na/en/index/industry_solutions/industries/hospitality/gaming.2.prod.html.

"Kiosk and Self-Service", http://www.zebra.com/id/zebra/na/en/index/industry_solutions/industries/hospitality/gaming2.prod.html.

"Retailer Draw-Based Game Procedures", http://www.natlotcomm.gov.uk/UploadDoes/Contents/Documents/Lotto_Schedule_7_Part_A_retail_game_procedures_28_02_05.pdf.

* cited by examiner 500
502
BUY IT ALL UP.
504
LOTTERY
506
WALNUT STREET
OAK STREET
HIGH STREET
LOW STREET
PARK AVE
MAIN STREET
GREEN STREET
NEW STREET
510
COLLECT ALL PROPERTIES OF A COLOR TO WIN!
512
1543789
508

540
554
LOTTERY
546
542
YOU HOLD:
NONE
YOU BOUGHT:
544
MAIN STREET
INSTRUCTIONS
552
37896
550
548

560
574
LOTTERY
YOU HOLD:
562
MAIN STREET
YOU BOUGHT:
564
PARK AVE
INSTRUCTIONS
572
56843
566
570
568

HYBRID INSTANT ONLINE LOTTERY GAME

PRIORITY CLAIM AND CROSSNOTING TO RELATED APPLICATION(S)

This application claims priority under 35, U.S.C. 119(e) to provisional patent application Ser. No. 60/680,607, titled Hybrid Instant Online Lottery Game, filed May 12, 2005. The entire contents of said application are incorporated herein by reference thereto.

BACKGROUND

Future-draw lottery games involve purchasing a chance or wager, usually in the form of a ticket, to match a result in a drawing to be held after the chance is purchased. Lotto and keno are two examples of future-draw lottery games. In an instant-win or instant lottery game, whether a ticket or chance will be a winner is determined before or at the time of purchase. Thus, a winning instant lottery ticket may typically be redeemed for a prize immediately. Common types of instant win lottery games include pre-printed tickets such as pull-tab tickets, peel-off tickets, or scratch-off tickets. Instant win lottery games may also be provided electronically, e.g., as described in U.S. Pat. No. 6,241,606, to Riendeau.

Pre-printed lottery tickets used for instant lottery games may be cumbersome and expensive. Typically, activated instant tickets are bearer instruments, with the winning tickets redeemable for cash. Security requirements necessitate the use of secure printing and distribution of pre-printed instant lottery tickets, and careful inventory control to prevent shrinkage. In addition, instant lottery tickets are traditionally printed in packs or books before the tickets are distributed to lottery retailers and lottery retail machines. This requires the lottery operator to determine the number of tickets to be printed for a particular instant lottery game before the instant lottery tickets are sold and to carefully and securely control the inventory of such tickets to prevent shrinkage and fraud. Also, printing the tickets before distribution and sale limits the speed and ease with which a lottery operator can change the instant lottery ticket games.

Instant lottery games are provided in a wide range of types, sizes, colors, and themes. They are typically sold as an "impulse purchase" item near a cash register or point of sale terminal, or from unattended terminals or vending machines in high traffic areas, for example train stations, other transportation hubs, bowling alleys, or other entertainment venues. Instant lottery games are typically printed with bright colors in a visually attractive design to attract consumer attention and encourage such impulse purchases.

In future-draw lottery systems, customers can typically purchase tickets at a dedicated lottery terminal in a convenience store or similar establishment, where the tickets are printed to order. Each dedicated lottery terminal communicates with a central lottery server to exchange information and instructions associated with a given lottery transaction. Although future-draw tickets are popular, they often do not have the attractive point of sale presence of instant tickets displayed at a cash register, nor do they have "impulse buying" attraction of instant lottery game tickets. Future-draw lottery systems are typically "planned" purchases, as opposed to impulse purchases. U.S. Pat. No. 5,772,510, to Roberts allows the printing of instant lottery tickets at a lottery terminal selling future-draw lottery tickets, but still requires a special ticket stock with pre-printed information.

DETAILED DESCRIPTION OF EXAMPLE EMBODIMENTS

Figure 1:
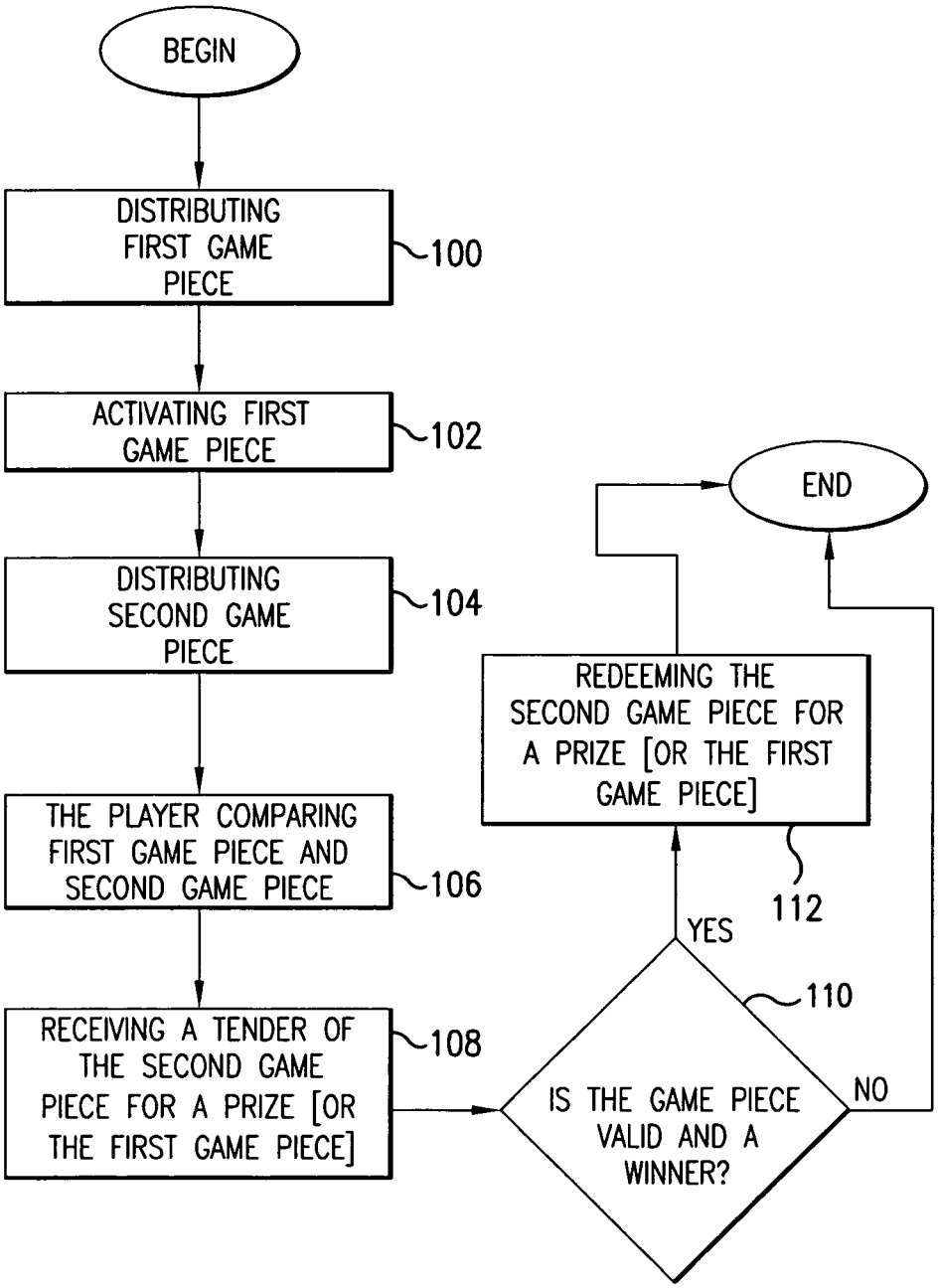
FIG. 1 illustrates an example procedure for conducting a lottery game, according to an example embodiment of the present invention.

One example embodiment of the present invention may include a lottery game and the procedures and apparatus needed for playing and conducting the lottery game. The example lottery game includes lottery game pieces of a first type. These first type pieces may be pre-printed and freely distributed, e.g., in mailings, or near a point of sale. The first type lottery game pieces may be printed in bright colors in visually attractive designs to attract customer attention and drive customer purchases. Included in the first type lottery game pieces is a set of lottery game play data, which may be represented graphically, or as a set of numbers, letters, or with other indicia. A player acquires one of these first type lottery game pieces and may decide to play the game. The lottery game piece may then be presented by the player as part of the purchase process for a chance in the lottery game, e.g., by having an identifying code read from the game piece at a conventional on-line lottery terminal that has been modified to support the type of game described herein. The player then receives a second set of lottery game data, which may be provided on a second game piece which may be printed at the online lottery terminal, or which may be printed on the first game piece, or which may be provided to the player in other ways, e.g., displayed on a video screen. The player may be given some sort of receipt that can be used to confirm that the player has purchased a chance in the game and that can be later used to redeem a winning chance, e.g., a unique validation code printed on the first or second game piece at the time of purchase. The purchase transaction and generation of game play data and validation code may be facilitated using a lottery client server system, such as a modification of the system described in the U.S. Provisional Patent Application for a Flexible Online Instant Lottery Game (U.S. Patent Application 60/645,488, filed Jan. 18, 2005), incorporated by reference herein in its entirety. The player can then ascertain the outcome of the game by comparing the first and second sets of lottery game data with reference to a predetermined set of game rules. For example, the first game piece may be a bingo card, and the second game piece may include a set of bingo draw numbers which may be compared to the bingo card on the first game piece, according to the rules of a conventional bingo game, in order to ascertain the game outcome. Once the player has determined that the chance is a winner by comparing the two sets of lottery game data ascertained to the predetermined rules, one of the game pieces may be redeemed for an appropriate prize by presenting the game piece at an appropriate location, e.g., a lottery game kiosk, an attended lottery terminal, or a lottery office redemption center. The validation code described above may be read from the ticket to allow the lottery system to confirm that a ticket presented for redemption is a valid winning ticket. Again, a client-server lottery system may be used to facilitate validation and redemption of winning chances. Alternatives to the procedure described above may also be used. Several example embodiments of procedures and apparatus for example lottery games and game systems are discussed in more detail below.

One example embodiment of the present invention may include a procedure for conducting a lottery game where the outcome can be ascertained by comparing sets of game play data according to predetermined games rules. The example procedure may include providing a player with a first game piece having a first set of game play data, receiving an indication the player wishes to purchase a chance in the lottery game, determining an outcome for the chance, generating a second set of game play data so that a comparison of the first set of game play data and the second set game play data is indicative of the outcome of the chance according to the predetermined game rules, providing the player with the second set of game play data, and awarding a prize to the player, the value of the prize depending on the outcome. The example embodiment may further include freely distributing the first game piece to the player. The example embodiment may further include the first game piece as part of a mailing. The example embodiment may further include displaying the first game piece at a point of sale. The example embodiment may further include dispensing the first game piece in conjunction with the completion of another purchase transaction. The example embodiment may further include a first game piece that is a pre-printed play slip with indicia indicative of the first set of game play data. The example embodiment may further include receiving the first game piece from the player, printing the second set of game play data on the first game piece, and returning the first game piece to the player. The example embodiment may further include receiving the first game piece from the player, and displaying the second set of game play data on a display. The example embodiment may further include printing a second game piece including the set of second set of game play data, and providing the second game piece to the player. The example embodiment may further include a second identifier on the second game piece, and associating the first identifier with the second identifier in a database. The example embodiment may further include receiving a tender of the second game piece for a prize. The example embodiment may further include a first identifier on the first game piece, and associating the first identifier with the first game data in a database. The example embodiment may further include receiving a tender of the first game piece for a prize. The example embodiment may further include determining the outcome by selecting a random entry from a prize pool.

Another example embodiment of the present invention may include a procedure of conducting a lottery game where the outcome can be ascertained by comparing sets of game play data according to predetermined games rules. The example procedure may include freely distributing a first game piece having first set of game play data and a first identifier, receiving from a player the first game piece and an indication that the player wishes to purchase a chance in the lottery game, reading the first identifier from the first game piece, determining an outcome for the chance, associating a unique second identifier with the chance, generating a second set of game play data so that a comparison of the first set of game play data and the second set of game play data indicates the outcome according to the predetermined game rules, providing the player with a second game piece having the second set of game play data and the second identifier, receiving a tender of the second game piece for a prize, reading the second identifier from the second game piece, and awarding a prize based on the outcome.

Another example embodiment of the present invention may include a procedure of conducting a lottery game where the outcome can be ascertained by comparing sets of game play data according to predetermined games rules. The example procedure may include freely distributing a first game piece having first set of game play data and a first identifier, receiving from a player the first game piece and an indication that the player wishes to purchase a chance in the lottery game, reading the first identifier from the first game piece, associating a unique second identifier with the chance, generating a second set of game play data so that a comparison of the first set of game play data and the second set of game play data indicates an outcome according to the predetermined game rules, providing the player with a second game piece having the second set of game play data and the second identifier, receiving a tender of the second game piece for a prize, reading the second identifier from the second game piece, and awarding a prize based on the outcome. The example embodiment may further include receiving an indication the player wishes to purchase a supplemental chance in the lottery game, determining a supplemental outcome for the supplemental chance, providing the player a supplemental set of game play data such that a comparison of the first set of game play data and the second set of game play data and the supplemental set of game play data indicates the supplemental outcome according to the predetermined game rules. The example embodiment may further include printing the supplemental set of game play data on one of the first or second game piece. The example embodiment may further include providing a supplemental game piece having the supplemental set of game play data. The example embodiment may further include providing the player with the opportunity to purchase a series of additional supplemental chances. The example embodiment may further include a procedure where supplemental chances can be purchased by the player at least until the player has a winning outcome. The example embodiment may further include a procedure where the supplemental set of game play data is associated with a supplemental unique identifier. The example embodiments may further include the player receiving a supplemental game piece including the supplemental set of game play data and the supplemental unique identifier. The example embodiment may further include associating a player and a player's information with the chance, the player's information including the supplemental chance, the first game piece, the second game piece, and the supplemental game piece. The example embodiment may further include contacting the player with game information.

Another example embodiment of the present invention may include an article of manufacture comprising a computer-readable medium having stored thereon instructions adapted to be executed by a processor, the instructions which, when executed, define a procedure to conduct a lottery game where the outcome can be ascertained by comparing sets of game play data according to predetermined games rules. The procedure may include an input routine receiving an indication a player wishes to purchase a chance in the lottery game, a run routine determining an outcome for the chance, a generation routine generating a second set of game play data so that a comparison of a first set of game play data and the second set of game play data is indicative of the outcome of the chance according to the predetermined game rules, an output routine providing the user with the second set of game play data, and an award routine awarding a prize to the player, the value of the prize depending on the outcome.

Another example embodiment of the present invention may include a lottery game system for playing a lottery game where the outcome can be ascertained by comparing sets of game play data according to predetermined game rules. The system may include a plurality of freely distributed game pieces each having a respective set of first set of game play data and a first identifier code, a terminal to receive a request to play the lottery game from a player and to read the first identifier code from one of the plurality of freely distributed game pieces presented by the player, a host in communication with the terminal, the host configured to receive the first identifier code from the terminal and to transmit second set of game play data to the terminal, an output device in communication with the terminal, the output device configured to provide the second set of game play data to the player, and a redemption station in communication with the host and configured to pay a prize to the player if a comparison of the first set of game play data and the second set of game play data indicates a winning outcome according to the predetermined rules. Some example embodiments of the present invention may include a redemption station as part of the terminal. The example embodiment may further include a second game piece output by the output device, the second game piece including the second set of game play data. The example embodiment may further include a unique second identifier code on the second game piece. The example embodiment may further include the redemption station configured to read the unique identifier and transmit the unique second identifier to the host. The example embodiment may further include a database accessible to the host, the database containing a plurality of records, at least one of the pluralities of records associating the first set of game play data, the second set of game play data, the second unique identifier, and a game outcome. The example embodiment may further include a payment acceptor configured to accept a payment, and a reader configured to read the first identifier code from first game piece. The example embodiment may further include a prize table containing a plurality of prizes available in the lottery game, an outcome table containing a plurality of outcomes generated in the lottery game, and a log containing a plurality of first game pieces and second game pieces dispensed by the ticket terminal. The example embodiment may further include the host in real-time communication with the terminal and the redemption station.

Another example embodiment of the present invention may include a first game piece including a first identifier and a first set of game play data, a second game piece including a second unique identifier associated with the first identifier and a second set of game play data, a ticket terminal including a payment acceptor configured to accept a payment, a reader configured to read the first game piece, and a dispenser configured to dispense the second game piece, the dispenser including a printer, a redeeming terminal configured to award a prize, a prize table containing a plurality of prizes available in the lottery game, an outcome table containing a plurality of outcomes generated in the lottery game a host in real-time communication with the ticket terminal and the redeeming terminal, the host further including a database containing a plurality of records, each record including the first set of game play data, the second set of game play data, the second unique identifier, a game outcome, and a log containing a plurality of first game pieces and second game pieces dispensed by the ticket terminal.

FIG. 1 illustrates an example procedure for conducting a lottery game, according to an example embodiment of the present invention. In 100, a first game piece may be distributed. The first game piece may be freely distributed by mailing it to players, placing it in a public area for players to take, providing it as a promotion with the receipt for another purchase transaction, or in other ways. The first game piece may also be distributed from a modified conventional lottery terminal upon request by a player.

The first game piece may be pre-printed, partially pre-printed, or printed to order. For example, like a conventional instant win lottery ticket, the first game piece may be printed in bright colors with attractive graphics to attract consumer attention. Examples of the first game piece may be as depicted in FIGS. 3A, 4A, 5A, and 12, discussed later. The first game piece distributed in 100 may include a first set of game play data, for example, graphical indicia used in the play of the lottery game. These may include numbers, letters, or other graphical elements for use in play of the game, which may be rendered in a bright, colorful, and visually attractive manner. The first game piece may also include instructions on how to play the game.

In 102, the first game piece may be activated, for example, as part of a player's request to purchase a chance in the lottery game. This activation may occur in response to the player indicating a desire to play the lottery game, e.g., by tendering the first game piece at a lottery terminal along with payment for a chance in the lottery game. For example, the first game piece may be activated at a lottery terminal by reading it at a reader, for example, by scanning a machine readable code on the first game piece, decoding a RFID tag, reading a smartcard, or reading a magnetic strip card. The first game piece may alternatively be activated at a lottery terminal by manually entering a first identifier associated with the first game piece.

The first game piece may also be activated through a player's own action, for example, scanning the first game piece at an unattended lottery kiosk or on their own personal computer via the internet. Alternatively, an agent at a point of sale terminal may activate the first game piece. If the point of sale is a convenience store or a supermarket checkout, the agent may be a convenience store employee or a supermarket checkout employee or an authorized lottery game representative or agent.

The lottery terminal may transmit the first identifier to a host. The host may record that the first game piece is activated, for example, by recording the identifier in a database. The host may check that the first identifier has not been placed on a do-not-activate list. A do-not-activate list may include a series of first identifiers associated with first game pieces not to be activated in the lottery game, for example, a test game piece, a sample game piece, or a game piece reported stolen.

In 104, a second game piece may be distributed. For example, a second game piece may be as depicted in FIGS. 3B, 4B, 5B, and 12, discussed later. The second game piece may be distributed from a retail store location such as a convenience store. The second game piece may alternatively be distributed from an automated kiosk located in a high traffic area. The second game piece may be distributed from the same or different location as the first game piece.

The second game piece distributed in 104 may include a second set of game play data, for example, graphically represented. The second game piece may include graphics and instructions on how to play the lottery game. The second set of game play data may be compared with the first set of game play data in accordance with predetermined game rules to ascertain whether the first game piece or the second game piece may be redeemed for a prize.

In 106, the player may compare the first set of game play data and the second set of game play data to ascertain whether the first game piece and the second game piece form a winning combination in accordance with predetermined game rules. For example, the comparison may be matching graphics or numbers between the first set of game play data and the second set of game play data, e.g. a winning chance might be if the hand indicated by the first set of game play data beats the hand represented by the second set of game play data. Alternatively, the comparison may be based on the value of a combination of cards indicated by the first set of game play data and the second set of game play data. For example, the first set of game play data and the second set of game play data may indicate a hand of cards in poker or blackjack, and winning or the value of a prize may depend on the rank of the hand in the card game. Alternatively, the two hands may be formed, and the winning the game or the value of a prize may depend on a comparison between the two hands, e.g., the player wins if a first hand beats a second hand according to the card game rules. Alternatively, the comparison may be based on the value of a combination of game pieces indicated by the first set of game play data and the second set of game play data in a board game, e.g., the game is won if the first set of game play data and second set of game play data, when combined, form a winning combination according to the rules of the game.

Figure 6:
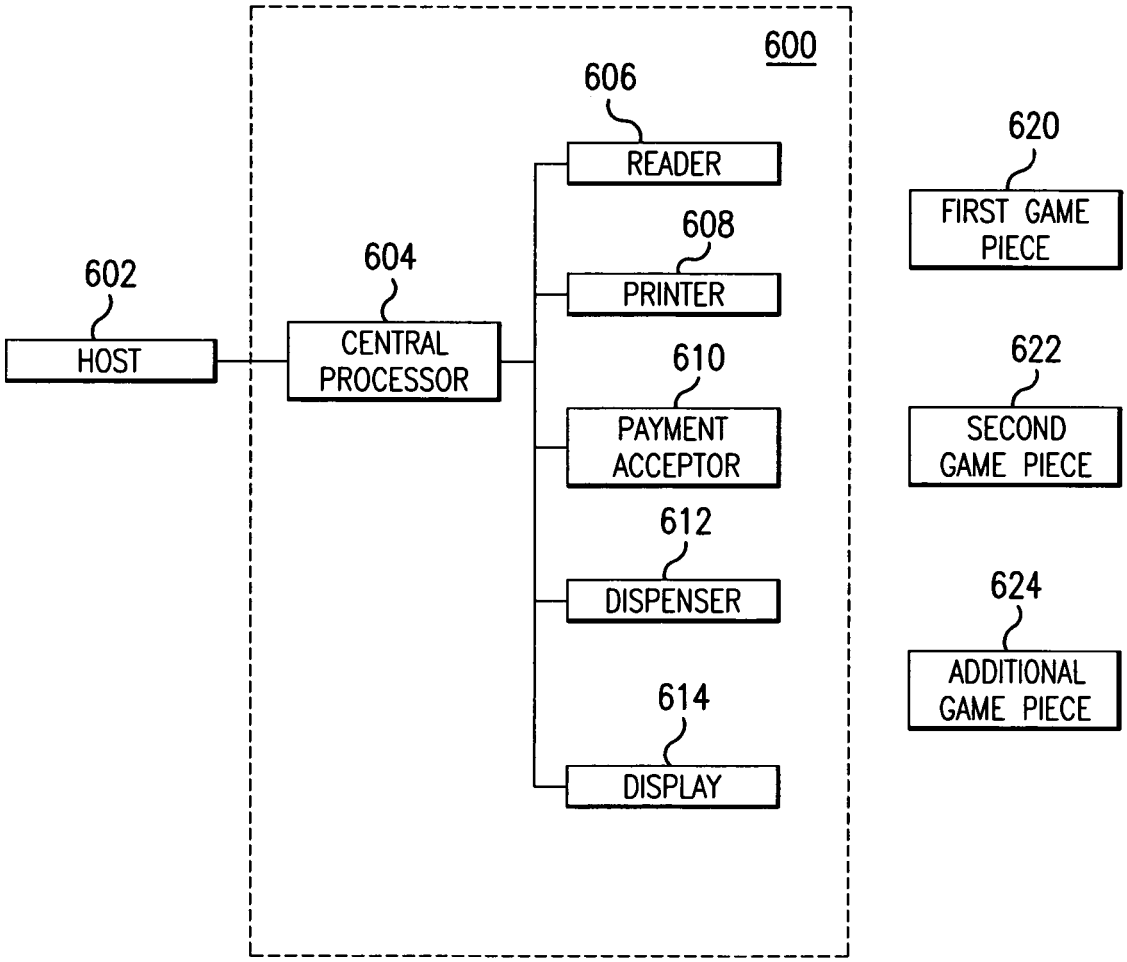
FIG. 6 illustrates an example of a lottery terminal, according to an example embodiment of the present invention.

In 108, a player may tender the second game piece to a lottery terminal for a prize. For example, a lottery terminal may be as depicted in FIG. 6. A player may alternatively tender the second game piece to an agent. For example, the player may tender the second game piece to a convenience store clerk or a lottery game representative authorized to redeem winning lottery tickets.

If the first set of game play data and the second set of game play data do not form a winning combination, the player may discard the first and second game pieces. If the player attempts to redeem the second game piece of a non-winning combination, the player may receive a message thanking him for playing and wishing him better luck next time. The player may also receive an error message explaining why the first game piece and the second game piece is not a winning combination. The player may also receive a prompt to purchase another game piece.

Alternatively, the player may tender the first game piece to the lottery terminal for a prize. The procedure is similar to that described above, except that the player tenders the first game piece instead of the second game piece. This alternative is noted in square brackets in FIG. 1.

In 110, a host operatively connected to the lottery terminal may determine whether the first game data and the second game data form a winning combination. The host may also determine whether the tendered game piece is valid. If the first set of game play data and the second set of game play data form a winning combination and the tendered game piece is valid, in 112 the player may receive a prize, for example, cash, a credit voucher, or another lottery ticket. In one example implementation, the prize may be sampled from a prize pool, e.g., by choosing a randomly chosen outcome from among a set of possible game outcomes by randomly selecting an entry in the pool. The prize pool may be stored on the host as a prize table. The prize pool may be updated after a prize is awarded.

Figure 2:
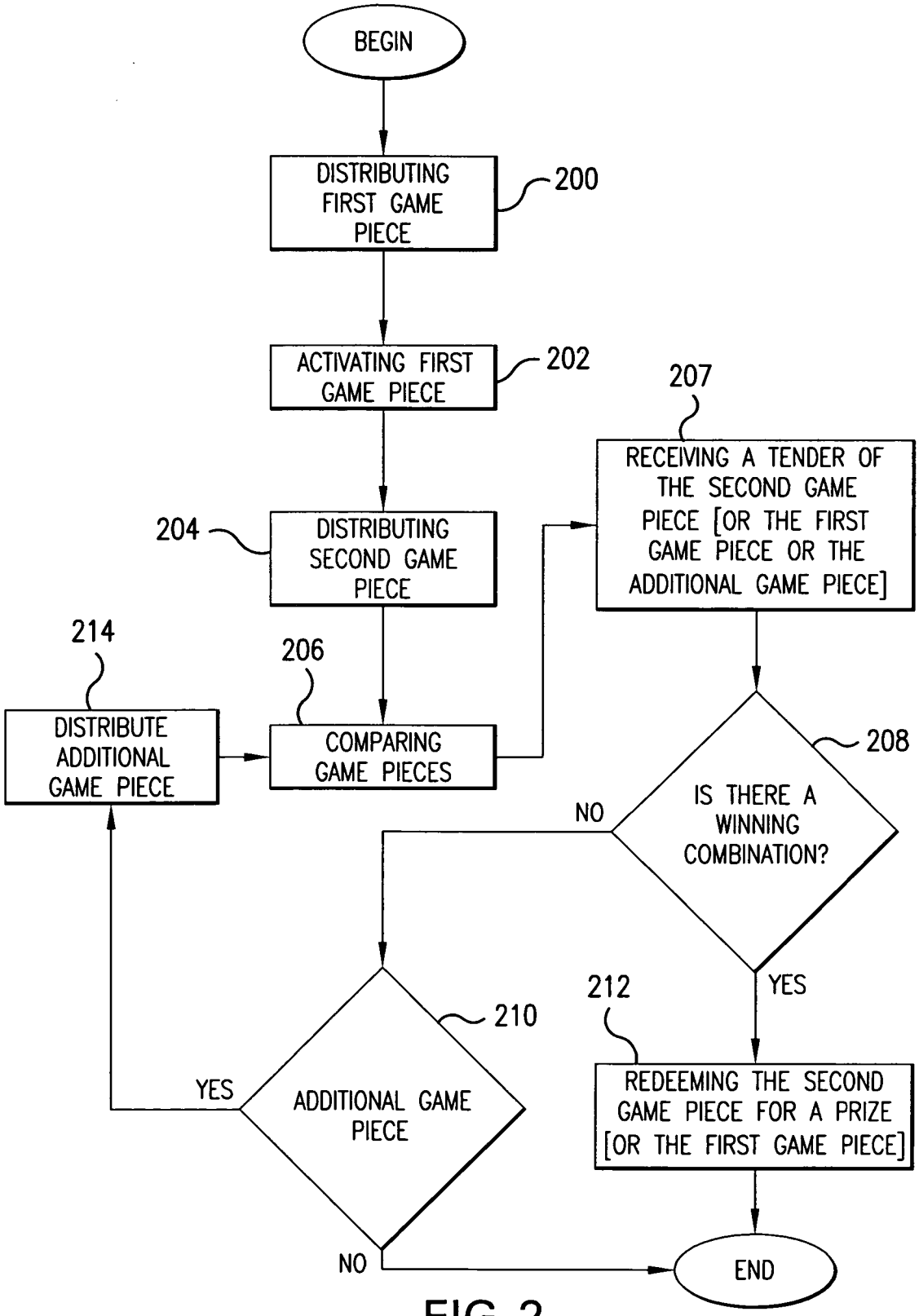
FIG. 2 illustrates another example procedure for conducting a lottery game, according to another example embodiment of the present invention.

FIG. 2 illustrates another example procedure for conducting a lottery game, according to another example embodiment of the present invention. A first game piece is distributed in 200, for example, a game piece like the ones depicted in FIGS. 3A, 4A, 5A, and 12. For example, the first game piece may be distributed from a retail store location such as a convenience store. The first game piece may alternatively be distributed from an automated kiosk.

The first game piece may include a first identifier. For example, the first identifier may be printed on the first game piece, or electronically encoded, for example, using a smart card, a RFID tag, or a magnetic swipe card. The first identifier may be used to identify the first game piece. The first identifier may be unique if each first game piece in a lottery game is unique, or alternatively may simply identify a particular type of first game piece.

The first game piece distributed in 200 may include a first set of game play data. The first game piece may include graphics and instructions on how to play the lottery game. For example, the first set of game play data may include sets of numbers to be compared to determine whether the first game piece may be redeemed for a prize. For example, the first set of game play data may also include sets of other information to be compared to determine whether the first game piece may be redeemed for a prize.

The first game piece may be activated in 202. For example, the first game piece may be activated by reading it into a lottery terminal. The first game piece may alternatively be activated at a retail store location with a human retail agent. For example, the human retail agent may scan the first game piece or manually enter the first identifier. The first game piece may alternatively be activated at an automated kiosk by the player or an agent of the lottery operating the game.

A second game piece may be distributed in 204. A second game piece may be as depicted in FIGS. 3B, 4B, 5B, and 12. For example, the second game piece may be distributed from a retail store location such as a convenience store. The second game piece may alternatively be distributed from an automated kiosk.

The second game piece distributed in 204 may include a second set of game play data. For example, the second game piece may comprise graphics and instructions on how to play the lottery game. The second set of game play data may be printed in bright colors in a visually attractive format.

The second game piece may be associated with a second unique identifier. For example, the second unique identifier may be included on the second game piece. The second unique identifier may be associated with the first identifier. For example, the second unique identifier may be identical to the first identifier, or may include some part of the first identifier.

The first set of game play data and the second set of game play data may be compared by the player in 206. The player may compare the second set of game play data with the first game data to determine whether the first game piece and the second game piece form a winning combination according to predetermined game rules. For example, the comparison may be matching graphics or numbers between the first set of game play data and the second set of game play data. Alternatively, the comparison may be based on the value of a combination of cards indicated by the first set of game play data and the second set of game play data. For example, the first set of game play data and the second set of game play data may indicate a hand of cards in poker or blackjack. A winning outcome or prize value may then be indicated by the rank of the hand in the card game. Alternatively, the comparison may be based on the value of a combination of game pieces indicated by the first set of game play data and the second set of game play data in a board game.

In 207, a player may tender the second game piece for a prize at a lottery terminal. The lottery terminal may be as depicted in FIG. 6. The player may alternatively tender the second game piece to a lottery game representative or agent.

In an alternative implementation, illustrated in square brackets, the player may tender the first game piece or an additional game piece for the prize at the lottery terminal. The procedure described above would remain similar except the player tenders the first game piece or the additional game piece instead of the second game piece.

If the game play data from the game pieces do not form a winning combination, the player may discard the game pieces. If the player attempts to redeem one of the game pieces of a non-winning combination, the player may receive a message thanking him for playing and wishing him better luck next time or encouragement to purchase another game piece.

In 208, a player determines whether the received sets of game play data form a winning combination. For example, if the first set of game play data and the second set of game play data form a winning combination, the player may redeem the first game piece or the second game piece in 212 for a prize.

In one example embodiment, the game rules allow the players to continue playing until they win. For example, the player may decide whether to purchase an additional game piece in 210. If there is not a winning combination, additional game pieces may be distributed in 214. Each additional game piece may change the pool prize e.g., each additional game piece may change the outcome by providing a higher likelihood of winning with a smaller payout. The player may continue purchasing additional game pieces until the first game piece, the second game piece, and the additional game pieces form a winning combination. Alternatively, additional plays could give a higher payout, with a lower ultimate probability of winning, for example, a double or nothing type of game.

In another alternative example embodiment, the player may be able to purchase an additional game piece regardless of whether there was a winning combination in 208.

If the player determines he has a winning combination in 208, he may redeem the first game piece or the second game piece or the additional game piece for a prize in 212. For example, a prize may be cash, a credit voucher, or another lottery ticket. The prize may be sampled from a prize pool.

Figure 3B:
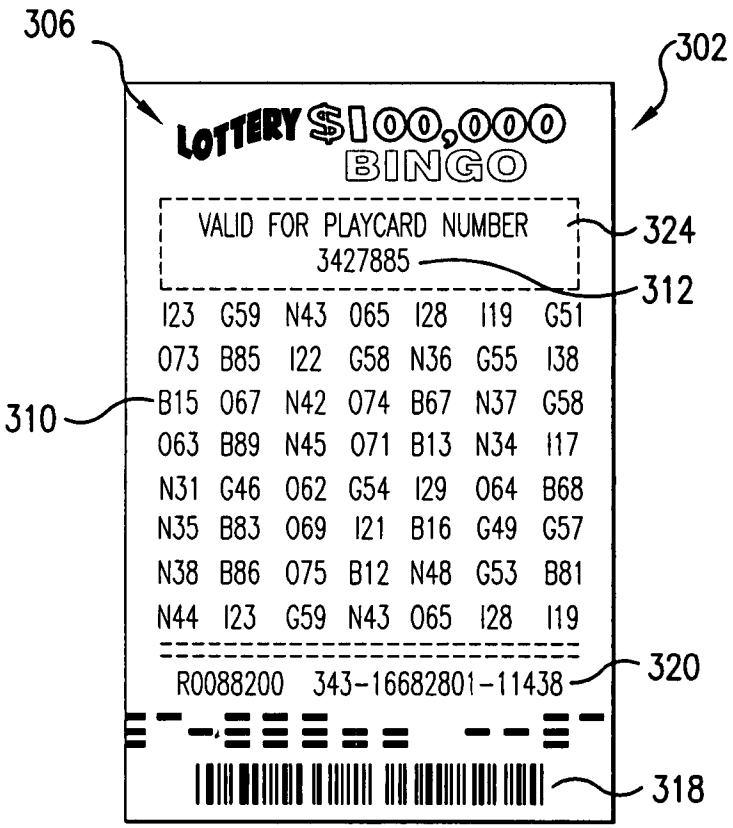
FIGS. 3A and 3B illustrate a pair of example game pieces, according to an example embodiment of the present invention.
Figure 3A:
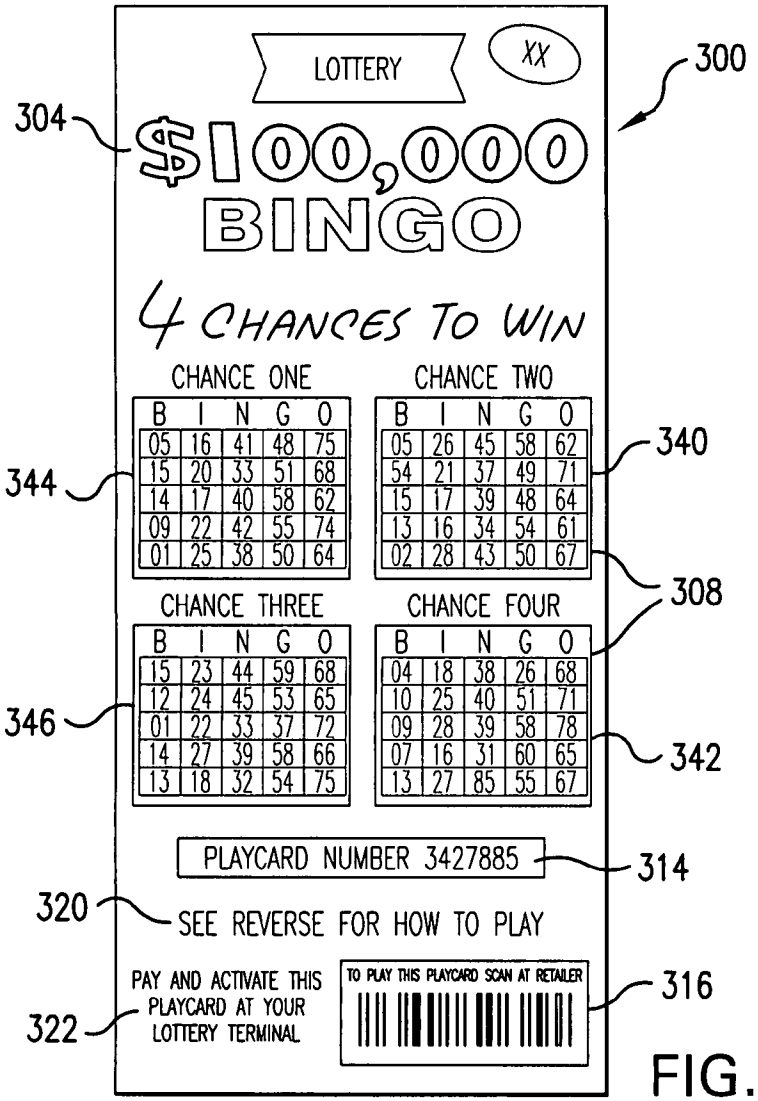

FIGS. 3A and 3B illustrate a pair of example game pieces, according to an example embodiment of the present invention. For example, a first game piece 300 and a second game piece 302 may be provided in a lottery game. The first game piece 300 may be a pre-printed paper slip. Altneratively the first game piece 300 may be a partially pre-printed paper slip or a print-to-order paper slip. The first game piece 300 may also be sold from a retail store location or an automated kiosk.

The first game piece 300 may include a first identifier 314. For example, a first identifier 314 may be a unique number, a unique sequence of characters, machine readable code such as a bar code, a smart card code, or a magnetic stripe, or an RFID tag.

The first game piece 300 may also include graphics 304, for example, the title of a lottery game, a logo, or other visually attractive graphics. The graphics 304 may also include other information related to the lottery game. The graphics 304 may also include advertisements related or unrelated to the lottery game.

The first game piece 300 may include a first game data 308. For example, the first game data 308 may include a plurality of Bingo boxes 340, 342, 344, 346. Each of the Bingo boxes 340, 342, 344, 346 may include a series of numbers to be compared in a bingo game. Other examples are described below and may include series of letters and numbers, playing cards, game boards, or other indicia for use in determining game outcome according to the game rules.

The first game piece 300 may also include game play instructions 320 and 322. For example, the game play instructions 320 and 322 may instruct a player on how to play the game, describe the rules of the game, describe the prize structure of the game, and provide contact information of a lottery company.

The first game piece 300 may include a machine readable code 316. For example, the machine readable code 316 may represent the first identifier 314. The machine readable code 316 may be used to activate the first game piece after purchase by a player. For example, the machine readable code 316 may be scanned at a lottery terminal or at a retail store location, e.g. to initiate the purchase of a chance in the game by a player.

The second game piece 302 may be distributed after the first game piece 300 is activated. Alternatively, the second game piece 302 may be distributed by displaying it on a display, by printing it on the first game piece 300, or by distributing it from a lottery terminal.

For example, to print the second game piece 302 on the first game piece, a player may insert the first game piece 300 into a lottery terminal, where the first game piece 300 may be read and activated. A second game piece 302 may then be printed on a portion of the first game piece 300 or on a separate piece of paper, as shown in FIG. 3B.

The second game piece 302 may include a second play data 310. For example, the second play data 310 may be a series of Bingo numbers. The Bingo numbers may indicate which elements of Bingo boxes 340, 342, 344, 346 are specified. For example, if a sufficient number or pattern of Bingo box elements in Bingo boxes 340, 342, 344, 346 are specified in the second play data 310 in a specified pattern, the first game piece 300 and the second game piece 302 may have a winning outcome. For example, a winning combination may be a vertical or horizontal line of four Bingo box elements in any of the Bingo boxes 340, 342, 344, and 346. The player may compare the elements of the second play data 310 with each Bingo box 340, 342, 344, and 346 to ascertain which Bingo box elements in Bingo boxes 340, 342, 344, and 346 are specified.

The second game piece 302 may include graphics 306. The graphics 306 may be, for example, the title of a lottery game, a logo, visually attractive graphics, or advertisements.

The second game piece 302 may include game play instructions 324. For example, the game play instructions 324 may instruct a player on how to play the game, describe the rules of the game, describe the prize structure of the game, or provide contact information of a lottery company. The game play instructions 324 may indicate that the second game piece 302 may be only valid for use with the first game piece 300.

The second game piece 302 may include the same identifier as the associated first game piece, e.g. the first identifier 314. The first identifier 314 may be depicted on the second game piece 302 as in 312. In some implementations, the second game piece 302 may be only valid when used with the first game piece 300.

The second game piece 302 may also include a second unique identifier 320. The second unique identifier 320 may be associated with the first identifier 314. For example, the second unique identifier 320 may be identical to the first identifier 314 or may include sine portion of the first identifier 314.

The second game piece 302 may also include a machine readable code 318. The machine readable code 318 may represent the first identifier 314 and may be used to ascertain a winning status of the second game piece 302 when the game piece is tendered for redemption. Alternatively, the machine readable code 318 may represent the second unique identifier 312.

Figure 4A:
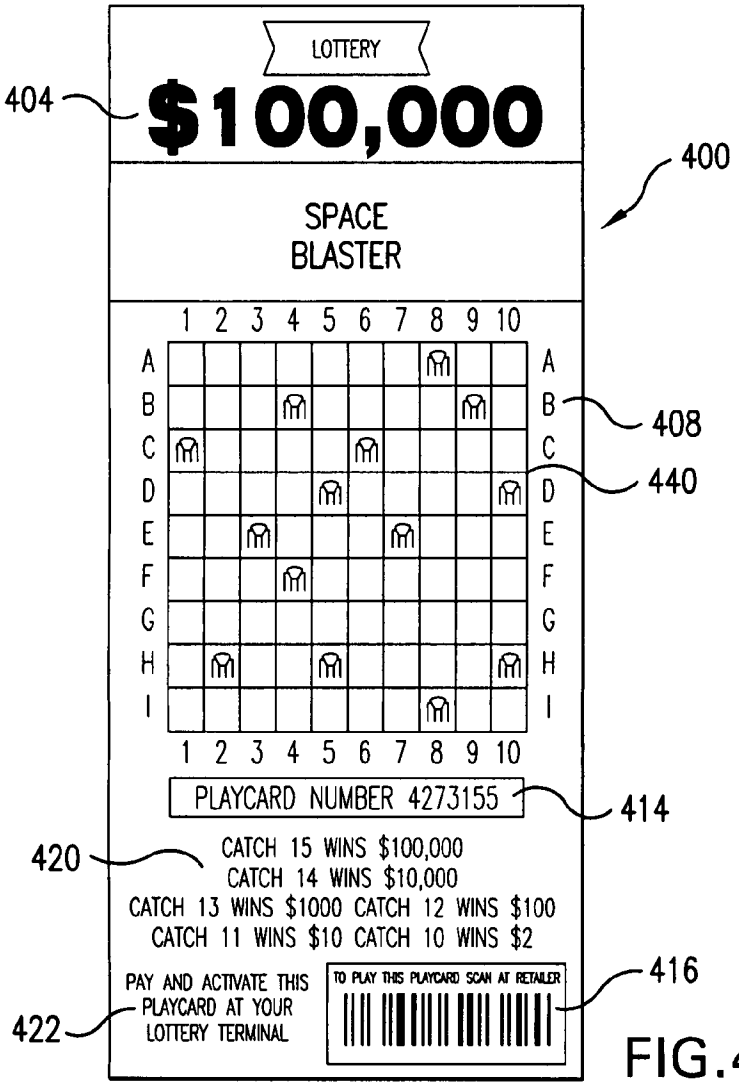
FIGS. 4A and 4B illustrate another pair of example game pieces, according to another example embodiment of the present invention.
Figure 4B:
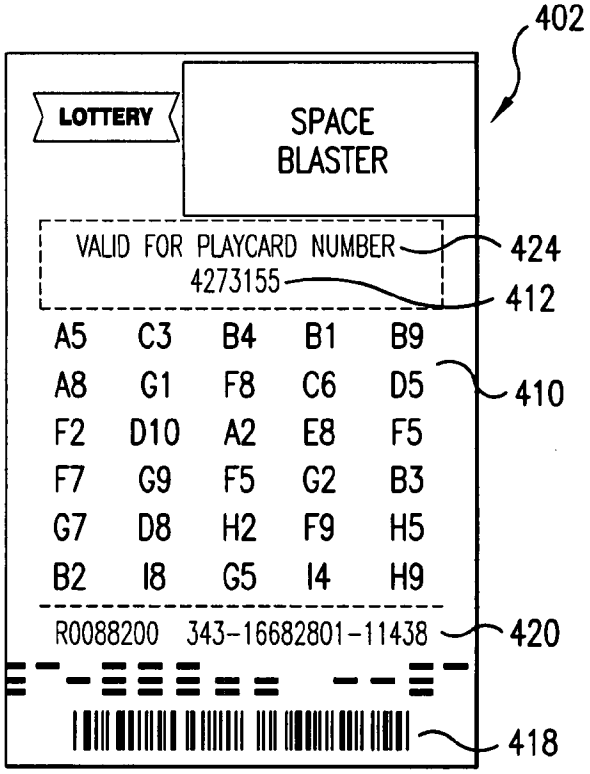

FIGS. 4A & 4B illustrate another pair of example game pieces, according to another example embodiment of the present invention. A first game piece 400 and a second game piece 402 may be provided in a lottery game. For example, the first game piece 400 may be a pre-printed slip and sold from a retail store location or an automated kiosk.

The first game piece 400 may include a first identifier 414. For example, the first identifier 414 may be a unique number, a unique sequence of characters, machine readable code, an RFID tag, or some other mechanism that can be read by a machine. Alternatively, the first identifier 414 may be non-unique in the lottery game, e.g. if these are multiple instances of play cards for the same game with the same game play data.

The first game piece 400 may include graphics 404. For example, the graphics 404 may be the title of a lottery game, a logo, or visually attractive graphics.

The first game piece 400 may include a first game data 408. For example, the first game data 408 may include a Space Blaster box 440, a grid including space themed symbols in a subset of the grid locations.

The first game piece 400 may include game play instructions 420 and 422. For example, the game play instructions 420 and 422 may instruct a player on how to play the game, describe the rules of the game, describe the prize structure of the game, or provide contact information of a lottery company.

The first game piece 400 may include a machine readable code 416. The machine readable code 416 may represent the first identifier 414, and may be used to activate the first game piece, e.g. when a player purchases a chance in the game. The machine readable code 416 may be scanned at a lottery terminal or at a retail store location.

The second game piece 402 may be distributed after the first game piece 400 is activated. For example, the second game piece 402 may be distributed by displaying it on a display, distributed from a lottery terminal, or by printing it on the first game piece 400.

To print the second game piece 402 on the first game piece, a player may insert the first game piece 400 into a lottery terminal, where the first game piece 400 may be read and activated. A second game piece 402 may then be printed on a portion of the first game piece 400.

The second game piece 402 may include a second play data 410. For example, the second play data 410 may be a series of square locations, which indicate a subset of the grid location in the Space Blaster box 440. If a sufficient number of Space Blaster box 440 containing predetermined indicia are specified in the second play data 410, the first game piece 400 and the second game piece 402 may have a winning outcome, with a prize that may increase with the number of matched locations.

The second game piece 402 may include graphics 406. For example, the graphics 406 may be the title of a lottery game, a logo, or visually attractive graphics.

The second game piece 402 may include game play instructions 424. For example, the game play instructions 424 may instruct a player on how to play the game, describe the rules of the game, describe the prize structure of the game, or provide contact information of a lottery company. The game play instructions 424 may indicate that the second game piece 402 is only valid for the first game associated piece 400 having the matching identifier.

The second game piece 402 may include the first identifier 414. For example, the first identifier 414 may be depicted on the second game piece 402 as in 412. In some example embodiments, the second game piece 402 may be only valid when used with the associated first game piece 400.

The second game piece 402 may include a second set of game play data 410. For example, the second set of game play data 410 may be a series of box elements. For example, the box elements may refer to elements in the Space Blaster box 440. For example, each element in the second set of game play data 410 may refer to an element in the Space Blaster box 440. The player may compare the first set of game play data and the second set of game play data by determining how many elements in the Space Blaster box 440 have been correctly specified. For example, the Space Blaster box 440 may be correctly specified if it contains a graphic and was included in the second set of game play data 410. A prize may be awarded if the Space Blaster box 440 includes a specified number of correctly specified elements. For example, the prize may be larger for a higher number of correctly specified elements.

The second game piece 402 may include a second unique identifier 420. For example, the second unique identifier 420 may be associated with the first identifier 414. For example, the second unique identifier 420 may be identical to the first identifier 414, or may contain a position of the first identifier 414.

The second game piece 402 may include a machine readable code 418. For example, the machine readable code 418 may represent the first identifier. Alternatively, the machine readable code 418 may represent the second unique identifier 412. The machine readable code 418 may be used to determine a winning status of the second game piece 402, e.g., when the same piece is tendered for a prize.

Figures 5A, 5B, 5C:
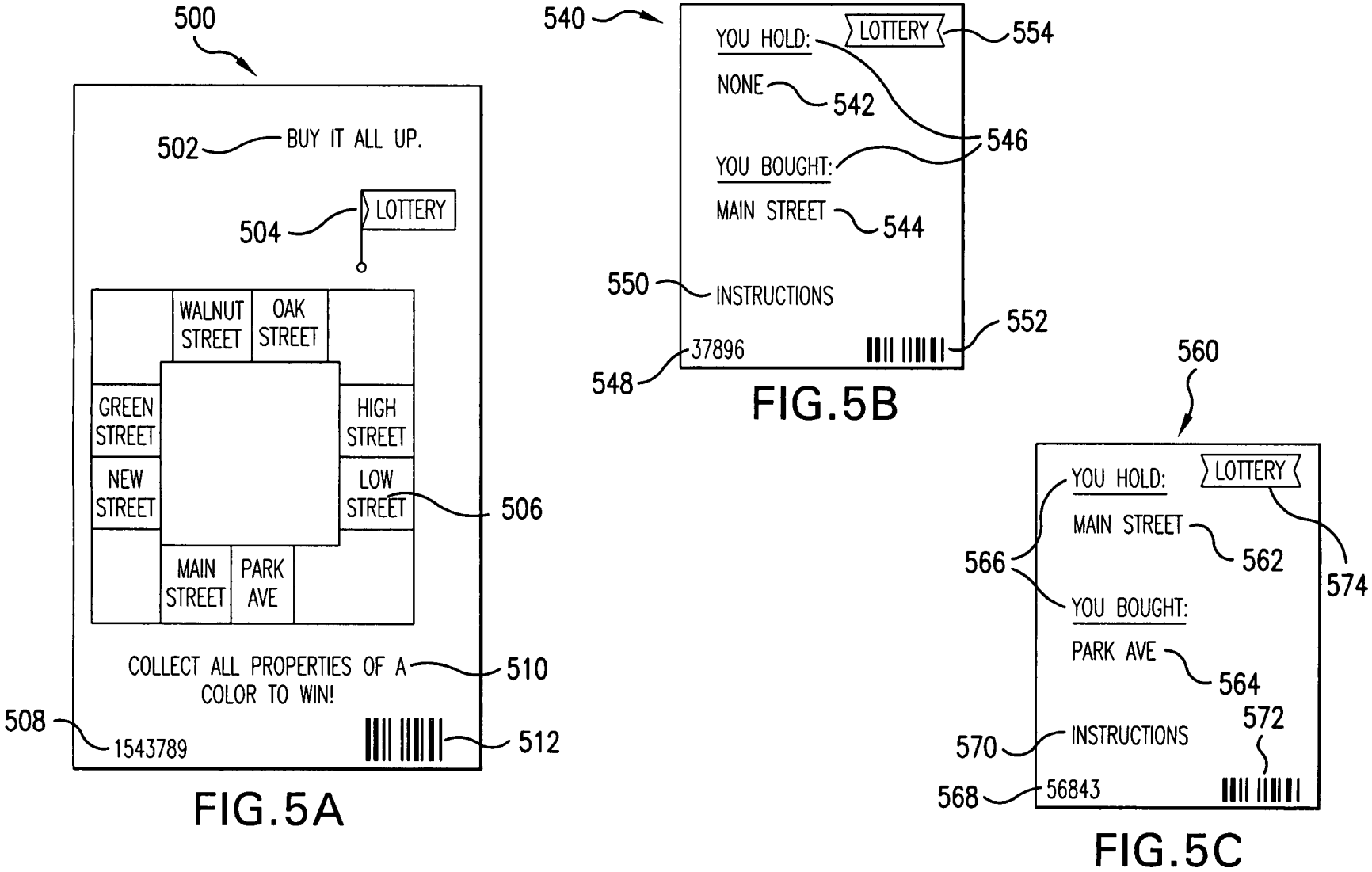
FIGS. 5A, 5B, and 5C illustrate a set of example game pieces, according to another example embodiment of the present invention.

FIGS. 5A, 5B and 5C illustrate a set of example game pieces, according to another example embodiment of the present invention. For example, a first game piece 500 may be a pre-printed slip, a partially pre-printed slip, or a print-to-order slip. For example, the first game piece 500 may be available for purchase through a retail store or an automated kiosk or may be freely distributed, or may be freely distributed.

The first game piece 500 may include a game title 502. For example, the game title 502 may be "Buy it All Up." The game title 502 may be depicted in a visually attractive and prominent manner in both color and layout. The first game piece 500 may also include graphics 504. For example, graphics 504 may be a logo or other visually attractive art.

The first game piece 500 may also include a first set of game play data 506. For example, the first set of game play data 506 may be a combination of graphics and text. In an example property accumulation game, the first set of game play data may include a map of the game layout and the names of all available properties. These may be multiple sets of properties, each set having a distinct color or being grouped in some other fashion.

The first game piece 500 may include a first identifier 508. For example, the first identifier 508 may be a unique number, a unique sequence of characters, machine readable code, or an RFID tag. For example, the first identifier 508 may be non-unique in the lottery game if multiple identical first game pieces are available, or may be unique if each first game piece is unique.

The first game piece 500 may include instructions 510. For example, the instructions 510 may instruct a player on how to play the game, describe the rules of the game, describe the prize structure of the game, or provide contact information of a lottery company.

The first game piece 500 may include a machine readable code 512. For example, the machine readable code 512 may represent the first identifier 508. The machine readable code 512 may be used to activate the first game piece 500 after purchase by a player. Alternatively, if the first game piece is not the redeemable element in the game, the first identifier may merely identify the first game piece to the system so that an appropriate redeemable game piece may be generated. In either alternative, the machine readable code 512 may be scanned at a lottery terminal or at a retail store location when a player is purchasing a chance in the game.

A second game piece 540 may include a list of properties already held 542. For example, the list of properties already held 542 may be empty until the first game piece 500 is first activated.

The second game piece 540 may include a second unique identifier 548. For example, the second unique identifier 548 may be a unique number, a unique sequence of characters, machine readable code, or an RFID tag. The second game piece 540 may be associated with the first identifier 508. For example, the second unique identifier may be identical to the first identifier 508, or may include some portion of the first identifier 508.

In some example embodiments, the second game piece 540 may only be valid with the first game piece 500 that has the associated first identifier 508.

The second game piece 540 may include a list of newly acquired properties 544. Each newly acquired property may be added to the list of properties already held 542. The list of newly acquired properties 544 may include one or more properties depicted on first set of game play data 506.

The second game piece 540 may include text 546. For example, the text 546 may be headings to the list of properties already held 542 and the list of newly acquired properties 544. The text 546 may also be rendered in a visually attractive manner.

The second game piece 540 may include a machine readable code 552. For example, the machine readable code 552 may represent the second unique identifier 548 in a machine readable form. The machine readable code 552 may also be used to verify the second game piece 540 when it may be redeemed. For example, the machine readable code 552 may be scanned at a lottery terminal or at a retail store location, when the second game piece is presented for redemption.

The second game piece 540 may include instructions 550. For example, the instructions 550 may instruct a player on how to play the game, describe the rules of the game, describe the prize structure of the game, or provide contact information of a lottery company.

The second game piece 540 may include graphics 554. For example, graphics 554 may be a logo or other visually attractive art. The example game using the game pieces shown in FIGS. 5A, 5B, and 5C may allow the player to purchase additional chances multiple times, each time receiving additional game information on a new ticket.

An example additional game piece 560 may include a list of properties already held 562. The list of properties already held 562 may be empty until the first game piece 500 is first activated, and each additional chance purchased by a player may add additional game play information, providing additional chances to win.

The additional game piece 560 may include an additional unique identifier 568. For example, the additional unique identifier 568 may be a unique number, a unique sequence of characters, machine readable code, or an RFID tag, or game, the additional unique identifier 568 that is not human readable.

The additional game piece 560 may be associated with the first identifier 508. The additional game piece 560 may only be valid with the first game piece 500, or with some set of earlier-acquired game pieces. Alternatively, each new game piece acquired by a player may include all of the play information acquired so far, and be separately redeemable without saving the earlier game pieces.

The additional game piece 560 may include a list of newly acquired properties 564. Each newly acquired property may be added to the list of properties already held 562. For example, the list of newly acquired properties 564 may include one or more properties depicted on first set of game play data 506.

The additional game piece 560 may include text 566. For example, the text 566 may be headings to the list of properties already held 562 and the list of newly acquired properties 564. The text 566 may be rendered in a visually attractive manner.

The second game piece 560 may include a machine readable code 572. The machine readable code 562 may represent the additional unique identifier 568. The machine readable code 572 may also be used to verify the additional game piece 560 when it may be redeemed. For example, the machine readable code 572 may be scanned at a lottery terminal or at a retail store location.

The additional game piece 560 may include instructions 570. For example, the instructions 570 may instruct a player on how to play the game, describe the rules of the game, describe the prize structure of the game, or provide contact information of a lottery company.

The additional game piece 560 may also include graphics 574. For example, the graphics 574 may be a logo, an advertisement, or other visually attractive art or information.

A player may win a game played with the same pieces shown in FIGS. 5A, 5B and 5C when he has accumulated all the properties in a group, e.g., of a particular color. For example, the player will have a first game piece 500, a second game piece 540, and as many additional game pieces 560 as he needs to accumulate a winning set properties. At that point, the player may purchase additional game pieces 560 in order to accumulate all the properties of a second color. The player may repeatedly purchase other additional game pieces 560 until he wins a second time.

FIG. 6 illustrates an example of a lottery terminal, according to an example embodiment of the present invention. The lottery terminal may be a modified version of a conventional ALTURA™ or ISYS™ lottery terminal, or a modified version of a GamePoint™ self-service terminal, available from GTECH Corporation, in West Greenwich, R.I. The lottery terminal 600 may be an automated kiosk, integrated into a point of sales terminal, or a personal computer. The lottery terminal may be programmed to conduct the example game play procedures described in the present application.

The lottery terminal 600 may be placed on a counter in a retail store or convenience store, a traffic hub such as a train station, airport, or rental car location, an entertainment venue such as a movie theater, bowling alley, or pool hall. The lottery terminal 600 may be in communication with a host 602. For example, the lottery terminal 600 may be in real time or batch-asynchronous communication with the host 602.

The lottery terminal 600 may include a central processor 604. For example, the central processor 604 may be configured to communicate and control a reader 606, a printer 608, a payment acceptor 610, and a dispenser 612.

The lottery terminal 600 may include a reader 606. The reader 606 may be configured to read a machine readable code on a first game piece 620, e.g., when the player presents the first game piece as part of a request to play a game. The first game piece 620 may be a first game piece as depicted in FIGS. 3, 4, 5, or 12. After the first game piece 620 is read, it may be activated by the central processor 604. The central processor may communicate information from the first game piece 620 to the host 602, e.g., an identifier read from the first game piece.

The lottery terminal 600 may include a display 614. The display 614 may be configured to display information to a player. For example, the display 614 may be placed behind a shatter and scratch resistant panel for protection and may also have other security measures.

The lottery terminal 600 may include a printer 608. The printer 608 may be configured to print a second game piece 622. For example, the second game piece 622 may be a second game piece as depicted in FIGS. 3, 4, 5, or 12, which may be printed in response to player's request to play a game using the first game piece.

In another example embodiment of the present invention, the second game piece 622 may be printed on the first game piece 620. The player (or an agent) would insert the first game piece 620 into the printer 608. The printer would print the second game piece 622 on the first game piece 620.

In another example embodiment of the present invention, the second game piece 622 may be displayed on a display 614.

The printer 608 may also be configured to print an additional game piece 624. For example, the additional game piece 624 may be an additional game piece as depicted in FIG. 5.

The lottery terminal 600 may include a payment acceptor 610. For example, the payment acceptor 601 may be configured to accept cash, credit cards, debit cards, vouchers, or other forms of payment.

The lottery terminal 600 may include a dispenser 612. The dispenser 612 may be configured to dispense a first game piece 620. In one embodiment, a player may purchase a first game piece 620 from a lottery terminal 600, or it may be distributed freely as a promotional item.

The dispenser 612 may be configured to dispense a second game piece 622. In one embodiment, a player may activate a first game piece 620 from a lottery terminal 600 and receive a pre-generated second game piece 622.

Figure 7:
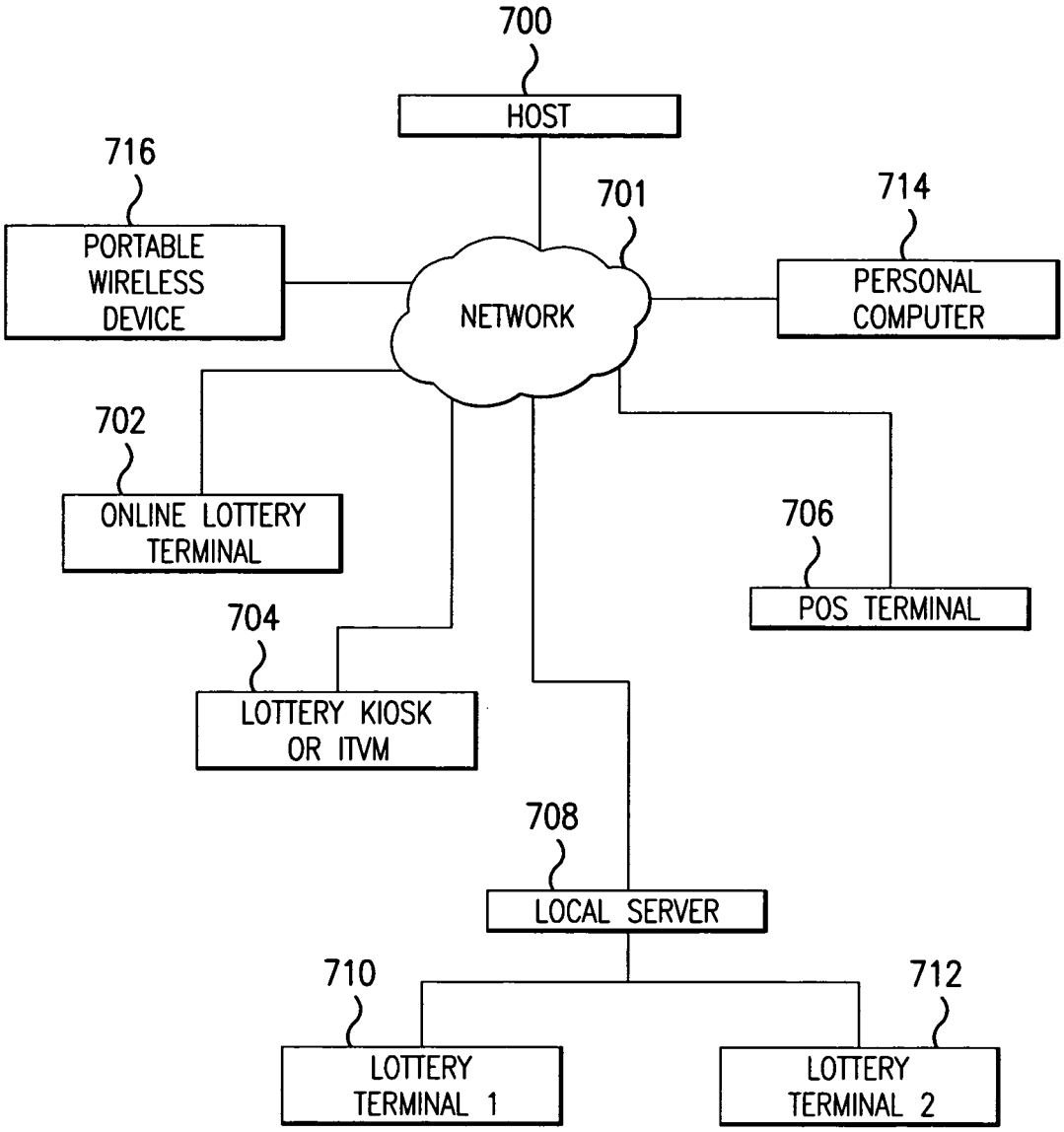
FIG. 7 illustrates an example of a client/server system, according to an example embodiment of the present invention.

FIG. 7 illustrates an example of a client/server system, according to an example embodiment of the present invention. The example client-server system may include a host 700 which may be connected to a network 701. The network 701 may be, for example, the Internet, an intranet, a local area network, a wide area network, a virtual private network, or other network. The communications between the host 700 and the network 701 and other communications over the network 701 may be encrypted.

An online lottery terminal 702 may be connected to the network 701. For example, the online lottery terminal 702 may be one as depicted in FIG. 6. The online lottery terminal 702 may be located in a store, for example, at the checkout counter. The online lottery terminal 702 may be in communication with the host 700 through the network 701. For example, the online lottery terminal 702 may be in real-time or asynchronous/batch communications with the host 700. The online lottery terminal 702 may be configured to dispense game pieces and accept payment. The communications between the online lottery terminal 702 and the network 701 may be encrypted.

A lottery kiosk, instant ticket vending machine (ITVM) or other type of self-service terminal 704 may also be connected to the network 701. For example, the lottery kiosk 704 may be an automated, unattended kiosk located in a high foot traffic area. The lottery kiosk 704 may be in communication with the host 700 through the network 701. The communications between the lottery kiosk 704 and the network 701 may be encrypted.

A local server 708 may be connected to the network 701. The local server 708 may be in communication with the host 700 through the network 701. The communications between the local server 708 and the network 701 may be encrypted.

The local server 708 may include a cache to store information. The local server 708 may have some or all functionality of the host 700. The local server 708 may mirror a database stored on the host 700. The local server may serve to manage a collection of lottery terminals, e.g., at a single large location, and to facilitate communications between these terminals and the host.

A lottery terminal 1 710 and a lottery terminal 2 712 may be connected to the local server 708. The lottery terminal 1 710 and the lottery terminal 2 712 may be as depicted in FIG. 6. The communications between the lottery terminal 1 710, the lottery terminal 2 712 and the network 701 may be encrypted. It will be appreciated that other devices, including other lottery terminals, may also be connected to the local server.

A point of sales terminal (POS) 706 may be connected to the network 701. For example, the POS terminal may be integrated into an existing POS terminal in a store. The POS terminal may prompt the player to purchase a ticket after the player completes a checkout transaction in the store. The communications between the point of sales terminal 706 and the network 701 may be encrypted.

A personal computer 714 may be connected to the network 701. The personal computer 714 may belong to the player. The personal computer 714 may have an attached local printer. The communications between the personal computer 714 and the network 701 may be encrypted. For example, the player may participate in a game through a secure internet connection with a web-server at the host.

A portable wireless device 716 may be connected to the network 701. The portable wireless device 716 may be, for example, a cell phone or a wireless personal data assistant (PDA). For example, the portable wireless device 716 may allow the player to play in a lottery game remotely.

Figure 8:
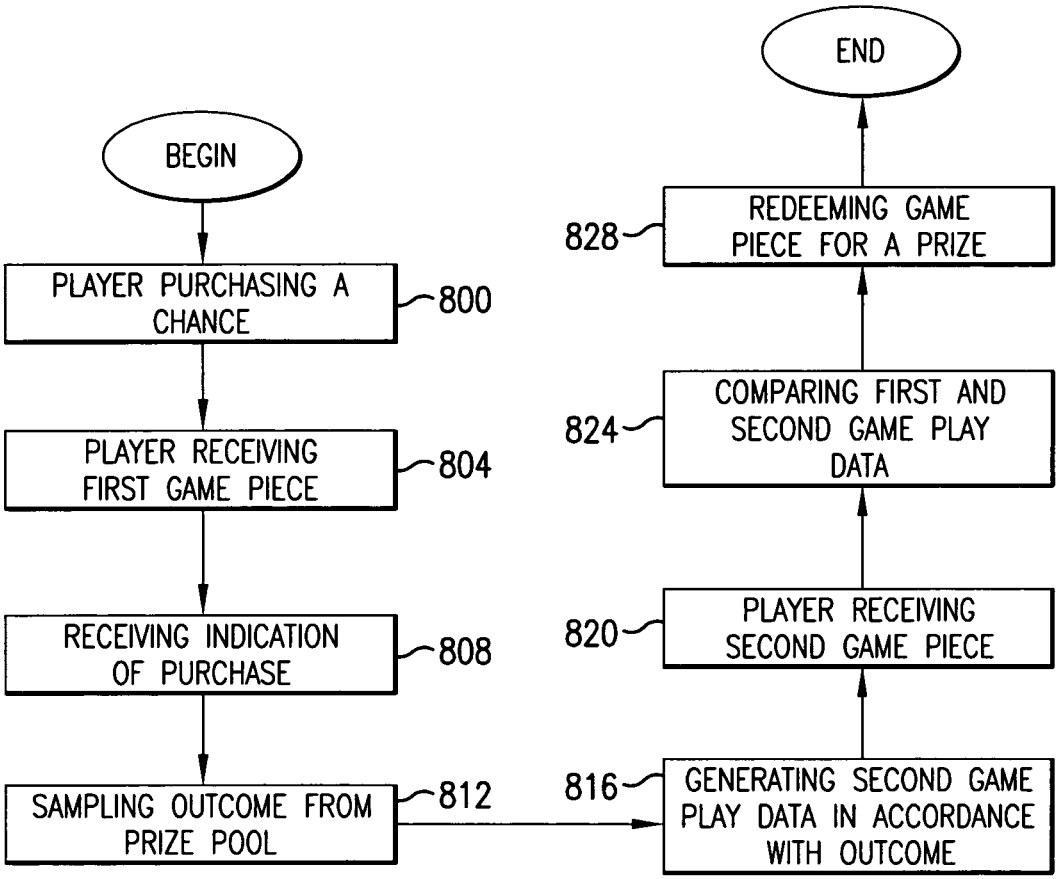
FIG. 8 illustrates another example procedure for conducting a lottery game, according to another example embodiment of the present invention.

FIG. 8 illustrates another example procedure for conducting a lottery game, according to another example embodiment of the present invention. In 800, a player may purchase a chance in the game. The chance may be purchased from a lottery terminal, e.g., one of the terminals illustrated previously. For example, a lottery terminal may be placed on a retail store counter and operated by an attendant, integrated into a point of sales terminal, or an automated kiosk.

In some implementations, a chance may be an opportunity to win a prize in a lottery game. A chance may be associated with a player after purchase. A player may be required to present proof of identification upon purchase of the chance. A player's proof of identification may be transmitted to a host.

The player may be asked to provide his personal information, for example, contact information and biographical information. Biographical information may be used, for example, for market research. For example, the player's contact information may be used to send game information to the player. Game information may include, for example, reminders to play the lottery game, announcements of special prizes, and the player's possession of a possible winning chance. Information on the chance may be transmitted to a host and stored in a database. For example, this information may be used to implement a frequent player program. A frequent player program may reward a player who frequently plays the lottery game with prizes such as, for example, free tickets or free merchandise.

Alternatively, the chance need not be associated with the player, but may instead be associated with a ticket or play card which might be redeemed by anyone holding the winning card or ticket.

In 804, the player may receive a first game piece. The first game piece may be associated with the purchased chance. The first game piece may include a first set of game play data. The player may receive the first game piece from the lottery terminal. The player may receive the first game piece in the same transaction as his purchase of the chance. Alternatively, the player may receive the first game piece in a separate transaction at a different location. The first game piece may be, for example, a pre-printed color ticket printed on heavy paper. Alternatively, the first game piece may be freely distributed as a promotion.

For example, the first game piece may be sealed in an envelope, folded over and sealed, printed on the inside of the envelope. The envelope may include an insert, for example, a coupon for another lottery game or an advertisement for another lottery game.

In 808, the lottery terminal may receive an indication of purchase. For example, the indication of purchase may be provided by scanning a machine readable code on the first game piece, after the player has presented the first game piece. After an indication of purchase is received, the lottery terminal may communicate with a host and activate the first game piece. Alternatively, the indication of purchase may be provided by manually entering a unique identifier on the first game piece into the lottery terminal.

In 812, an outcome of the chance may be determined by sampling the outcome from a prize pool. For example, the sampling may be random in nature, or conducted in a predetermined order. Example methods of sampling are described in described in the U.S. Provisional Patent Application for a Flexible Online Instant Lottery Game (U.S. Patent Application 60/645,488, filed Jan. 18, 2005). The outcome of the chance may be either losing or winning. A losing outcome may not provide a prize. A winning outcome may provide the player with one or more prizes from the prize pool. For example, the prize pool may contain multiple types of prizes, both monetary and non-monetary. Monetary prizes maybe of different amounts. Non-monetary prizes may include another chance in the lottery game. The prize pool may be restricted so that a predetermined number of prizes of each type are given out in a lottery game.

The prize pool may be predetermined. Alternatively, the prize pool may change after the outcome of a chance is determined, e.g., if prizes are sampled without replacement. The prize pool may be stored at the host in memory as a prize table. The lottery terminal or the host may generate a random number and use the random number to select an entry from the prize pool.

In 816, a second set of game play data may be generated in accordance with the outcome. If the outcome is winning, the second set of game play data may be generated to form a winning combination with the first set of game play data, according to the game rules.

If the outcome is losing, the second set of game play data may be generated to form a losing combination with the first set of game play data. The second set of game play data may be associated with the first set of game play data, e.g., by printing the identifier of a first game piece containing the first set of game play data on the second game piece containing the second set of game play data. The second set of game play data may also be associated with the chance, e.g., using a transaction or player identifier.

In 820, the player may receive a second game piece. The second game piece may include the second set of game play data. For example, the second game piece may be printed at the lottery terminal and dispensed to the player. The second game piece may be associated with the first game piece. The second game piece may be associated with the chance.

In another example embodiment of the present invention, a player may not receive a second game piece. For example, the second set of game play data may be displayed on a display. In another example embodiment of the present invention, the player may insert the first game piece into the lottery terminal, and the second set of game play data may be printed on the first game piece.

In 824, the player may compare the first set of game play data and the second set of game play data. By comparing the first set of game play data and the second set of game play data, the player may ascertain whether the outcome of the chance is winning or losing. For example, the comparison may be matching graphics or numbers between the first set of game play data and the second set of game play data. Alternatively, the comparison may be based on the value of a combination of cards indicated by the first set of game play data and the second set of game play data. For example, the first set of game play data and the second set of game play data may together form a hand of cards in poker or blackjack. Hands of a particular rank result in a preset game outcome. Alternatively, each of the first and second sets of a game play data may form separate hands, and the player may win if the second hand beats the first hand. Alternatively, the comparison may be based on the value of a combination of game pieces indicated by the first set of game play data and the second set of game play data in a board game.

In 828, the player may redeem a game piece for a prize if the first set of game play data and the second set of game play data form a winning combination. For example, the redeemed game piece may be either the first game piece or the second game piece depending on how the game is implemented. A player may redeem the game piece at a lottery terminal. A small cash prize or additional lottery tickets awarded as a prize may be redeemed at the lottery terminal where tickets are sold. A large cash prize may be redeemed by an authorized lottery game representative or agent, e.g., at a special redemption center.

A player may be required to present proof of identification before redeeming a game piece. Proof of identification may, for example, be government issued identification such as a driver's license. Proof of identification may also, for example, be a credit or debit card. A lottery terminal may include a card reader to read a player's proof of identification. A player's proof of identification may be stored after a player redeems a game piece. A player's proof of identification may be compared with proof of identification stored when the player purchased the chance, if the proof of identification was required when the player purchased the chance. The prize pool may be updated after the game piece is redeemed and awarded.

Figure 9:
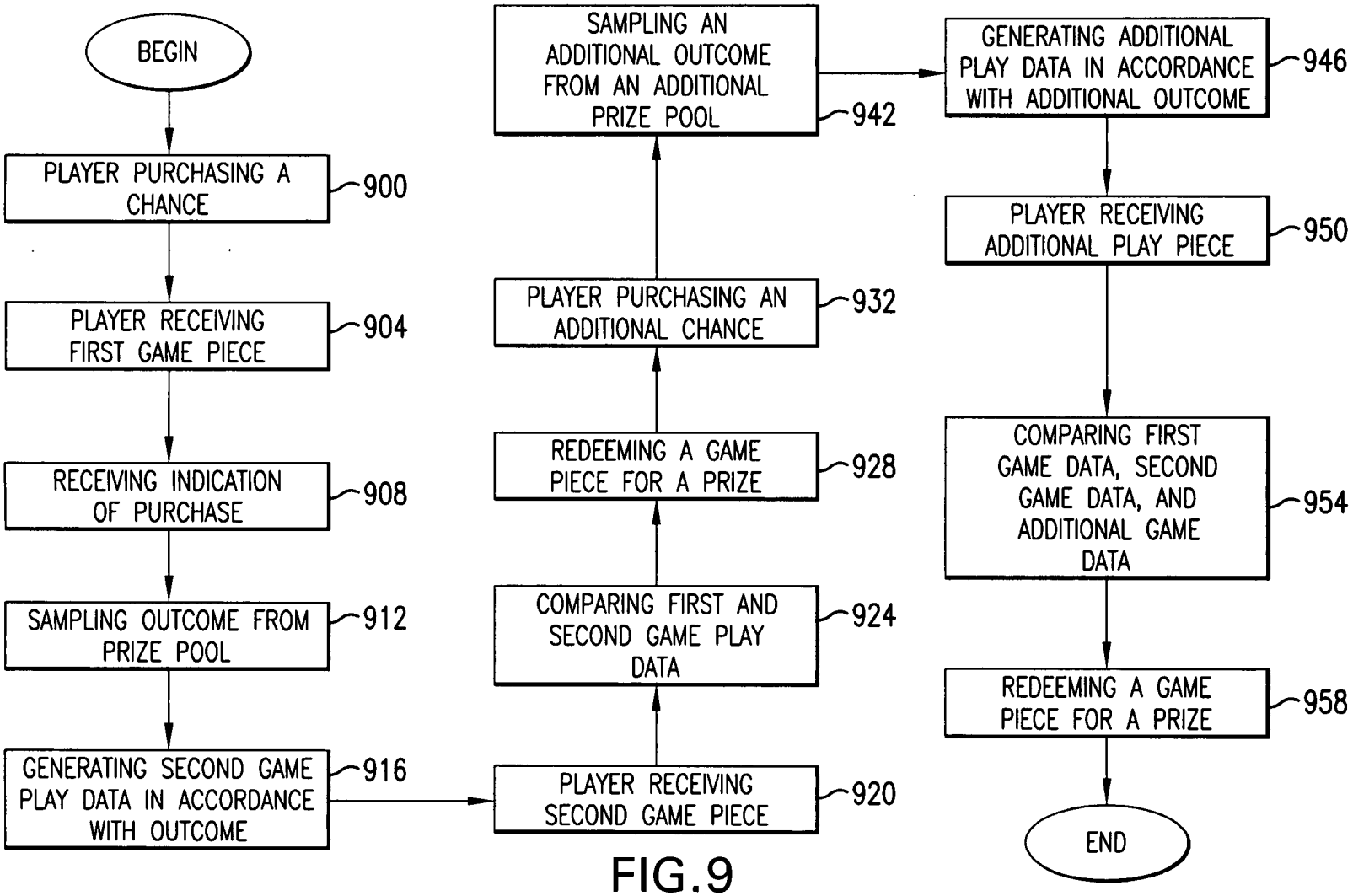
FIG. 9 illustrates another example procedure for conducting a lottery game, according to another example embodiment of the present invention.

FIG. 9 illustrates another example procedure for conducting a lottery game, according to another example embodiment of the present invention. In 900, a player may purchase a chance. The chance may be purchased from a lottery terminal. For example, the lottery terminal may be placed on a retail store counter and operated by an attendant, integrated into a point of sales terminal, or an automated kiosk. The chance may be an opportunity to win a prize in a lottery game and may be associated with a player after purchase. The player may be required to present proof of identification upon purchase of the chance. The player's proof of identification may be transmitted to a host. Alternatively, chances in the game may be anonymous and not associated with a player.

The player may be asked to provide his personal information, for example, contact information and biographical information. Biographical information may be used, for example, for market research. The player's contact information may be used to send game information to the player. Game information may include, for example, reminders to play the lottery game, announcements of special prizes, and the player's possession of a possible winning chance.

The chance may be associated with the player. Information on the chance may be transmitted to a host and stored in a database. This information may be used to implement a frequent player program. The frequent player program may reward a player who frequently plays the lottery game with prizes such as, for example, free tickets or free merchandise.

In 904, the player may receive a first game piece. The first game piece may be associated with the chance. The first game piece may include a first set of game play data. For example, the player may receive the first game piece from the lottery terminal in the same transaction as his purchase of the chance. Alternatively, the player may receive the first game piece in a separate transaction at a different location. For example, the first game piece may be a pre-printed color ticket printed on heavy paper.

The first game piece may also be distributed freely as a promotional item. For example, the first game piece may be sealed in an envelope, folded over and sealed, or printed on the inside of the envelope. For example, the envelope may also include an insert such as a coupon for another lottery game or an advertisement for another lottery game.

In 908, the lottery terminal may receive an indication of purchase. For example, the indication of purchase may be provided by scanning a machine readable code on the first game piece. The indication of purchase may also be provided by manually entering a unique identifier on the first game piece into the lottery terminal. After the indication of purchase is received, the lottery terminal may communicate with a host and activate the first game piece.

In 912, an outcome of the chance may be determined by sampling the outcome from a prize pool. Example methods of sampling are described in the U.S. Provisional Patent Application for a Flexible Online Instant Lottery Game (U.S. Patent Application 60/645,488, filed Jan. 18, 2005). For example, the sampling may be random in nature, or conducted in a predetermined order. The outcome of the chance may be either losing or winning. A losing outcome may not provide a prize. A winning outcome may provide the player with one or more prizes from the prize pool. For example, the prize pool may contain multiple types of prizes, both monetary and non-monetary. Monetary prizes may be of different amounts. Non-monetary prizes may include another chance in the lottery game. The prize pool may be restricted so that a predetermined number of prizes of each type are given out in a lottery game.

The prize pool may be predetermined. The prize pool may change after the outcome is determined, e.g., if prizes are awarded without replacement. The prize pool may be stored at the host in memory as a prize table. For example, the lottery terminal or the host may generate a random number and use the random number to select an entry from the prize pool.

In 916, a second set of game play data may be generated in accordance with the outcome. If the outcome is winning, the second set of game play data may be generated to form a winning combination with the first set of game play data, so that a player can ascertain the correct game outcome by comparing the first and second sets of game play data.

If the outcome is losing, the second set of game play data may be generated to form a losing combination with the first set of game play data. The second set of game play data may be associated with the first set of game play data, e.g., by printing it with an identifier associated with the first set of game play data. The second set of game play data may be associated with the chance, e.g., by storing the game play data in a database table with entries corresponding to each chance sold.

In 920, the player may receive a second game piece. The second game piece may include the second set of game play data. For example, the second game piece may be printed at the lottery terminal and dispensed to the player. The second game piece may be associated with the first game piece and the chance, e.g., by printing identifiers on the second game piece.

In another example embodiment of the present invention, a player may not receive a second game piece. For example, the second set of game play data may be displayed on a display or printed on the first game piece.

In 924, the player may compare the first set of game play data and the second set of game play data. By comparing the first set of game play data and the second set of game play data, the player may ascertain whether the outcome of the chance is winning or losing.

In 928, the player may redeem a game piece for a prize if the first set of game play data and the second set of game play data form a winning combination. Depending on the implementation, the redeemed game piece may be either the first game piece or the second game piece. The player may redeem the game piece at a lottery terminal or at some other location. For example, a small cash prize or additional lottery tickets awarded as a prize may be redeemed at a lottery terminal where tickets are sold. A large cash prize may be redeemed by an authorized lottery game representative or agent, e.g., at a special redemption center.

A player may be required to present proof of identification before redeeming a game piece. Proof of identification may, for example, be government issued identification such as a driver's license. Proof of identification may also, for example, be a credit or debit card. A lottery terminal may include a card reader to read a player's proof of identification. A player's proof of identification may be stored after a player redeems a game piece. A player's proof of identification may be compared with proof of identification stored when the player purchased the chance if the player was required to present proof of identification at the time of purchase. The prize pool may be updated after the game piece is redeemed and awarded.

In 932, the player may purchase an additional chance in the game. The player's previous chance may have had an outcome of losing, but the player may desire to continue playing the game using the game play data they already have. For example, the player may purchase an additional chance from a lottery terminal by presenting one of the game pieces already used to play the game.

In 942, the lottery terminal or the host may determine an additional outcome for the additional chance. The additional outcome of the additional chance may be determined by sampling the additional outcome from an additional prize pool. For example, the sampling may be random in nature, or conducted in a predetermined order. For example, the additional outcome of the additional chance may be either losing or winning. A losing additional outcome may not provide a prize. A winning additional outcome may provide the player with one or more prizes from the additional prize pool.

The additional prize pool may be the same as the original prize pool. Alternatively, the additional prize pool may include bigger or more attractive prizes than the original prize pool, or smaller prizes with a greater chance to win.

In 946, an additional set of game play data may be generated in accordance with the additional outcome. If the additional outcome is winning, the additional set of game play data will combine with the first set of game play data and the second set of game play data to form a winning combination. The additional set of game play data may be associated with the first set of game play data and the second set of game play data, e.g., by printing identifiers on an additional game piece. The additional set of game play data may also be associated with the chance, e.g., by storing it in an appropriate database table.

In 950, the player may receive an additional game piece. The additional game piece may include the additional set of game play data. For example, the additional game piece may be printed at the lottery terminal and dispensed to the player. The additional game piece may be associated with the first game piece and the second game piece, e.g., by printing an identifier from the first and/or second game piece on the additional game piece.

In 954, the player may compare the first game data, the second game data, and the additional game data. By comparing the first game data, the second game data, and the additional game data, the player may ascertain whether the outcome of the additional chance is winning or losing. For example, the comparison may be matching graphics or numbers between the first set of game play data and the second set of game play data. Alternatively, the comparison may be based on the value of a combination of cards indicated by the first set of game play data and the second set of game play data. For example, the first set of game play data and the second set of game play data may together form a hand of cards in poker or blackjack, and the value of the hand indicates the game result. Alternatively, the comparison may be based on the value of a combination of game pieces indicated by the first set of game play data and the second set of game play data in a board game.

In 954, the player may redeem a game piece for a prize. Depending on the implementation, the redeemed game piece may be the first game piece, the second game piece, or the additional game piece.

Figure 10:
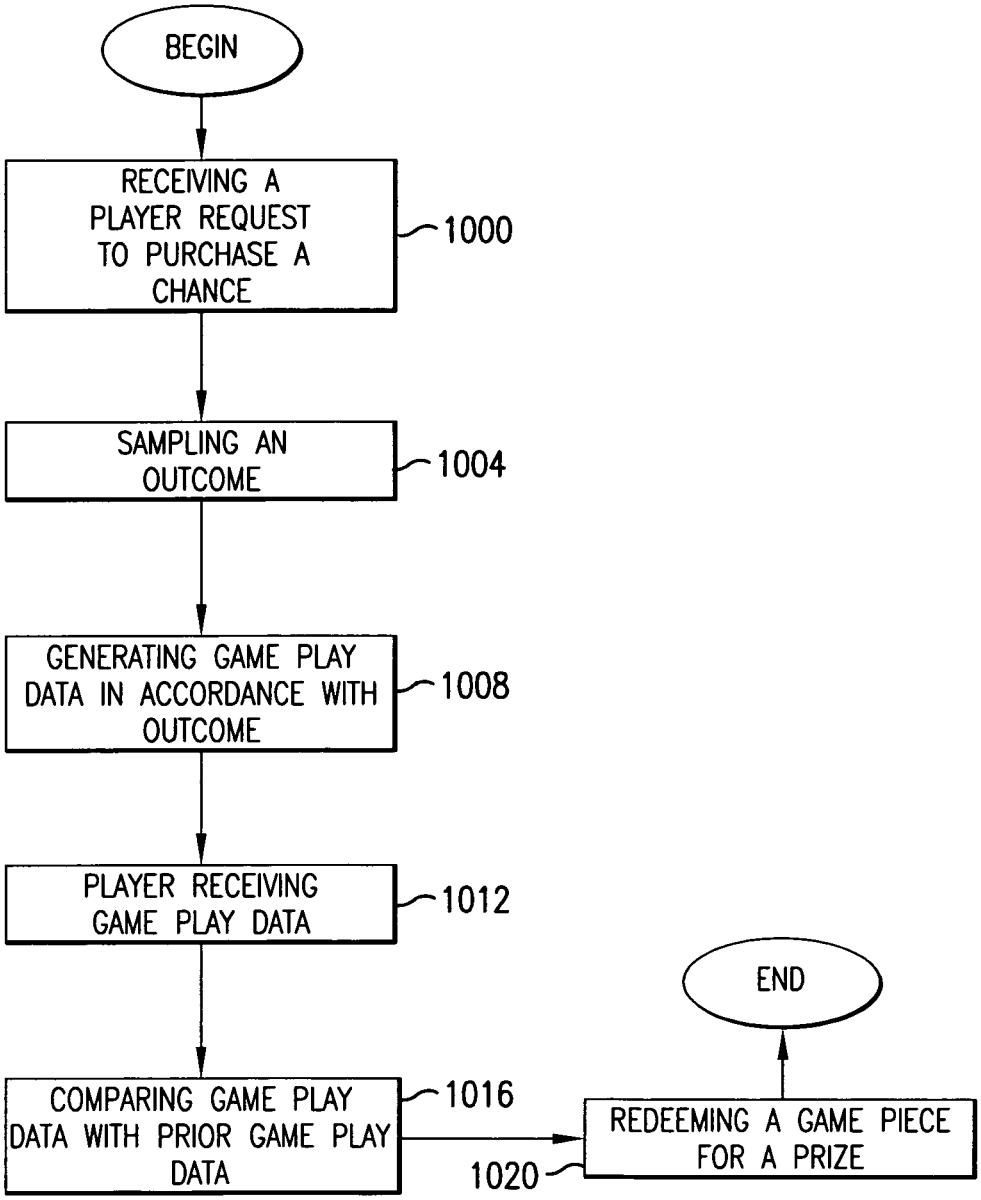
FIG. 10 illustrates another example procedure for conducting a lottery game, according to another example embodiment of the present invention.

FIG. 10 illustrates another example procedure for conducting a lottery game, according to another example embodiment of the present invention. In 1000, a player may purchase a chance. The chance may be purchased from a lottery terminal. For example, the lottery terminal may be located on a store counter, or in an automated kiosk.

The player may be required to enter his contact information, for example, his mailing address, telephone number, and email address. The player may be required to provide proof of identification. The lottery terminal may transmit this information to a host. The player's contact information may be used to send game information to the player. For example, the player may be reminded to keep playing the lottery game and informed of special prizes or new prizes added to the prize pool. The chance may be associated with the player's information. Alternatively, the chance may be anonymous. The chance may be stored on the host or the lottery terminal, and may be associated with a game piece having a unique identifier, rather than with a particular player.

In 1004, an outcome may be sampled from a prize pool. For example, the sampling may be random in nature, or conducted in a predetermined order. Example methods of sampling are described in described in the U.S. Provisional Patent Application for a Flexible Online Instant Lottery Game (U.S. Patent Application 60/645,488, filed Jan. 18, 2005). For example, the prize pool may be a predetermined pool of prizes to be awarded in the lottery game. If the outcome is winning, a winning outcome may award one or more prizes from the prize pool. The outcome may be losing. A losing outcome may not award a prize.

The prize pool may be stored on the host as a prize table. The prize pool may be updated after a winning outcome to remove the prize from the pool, e.g., if prizes are awarded without replacement.

In 1008, a set of game play data may be generated in accordance with the outcome. If the outcome is winning, a winning set of game play data may be generated. If the outcome is losing, a losing outcome may be generated. The game play data may be chosen so that when it is combined with original game play data, the combination is indicative of the correct outcome.

The set of game play data may depend on the player's prior chances. One example embodiment of the present invention may be a property accumulation lottery game. A winning outcome occurs when a player collects all properties in a group, e.g., of a particular color. A winning outcome may generate set of game play data representing the last property of a set of properties that completes a partial set of properties already held by the player.

In 1012, the player may receive the set of game play data. The set of game play data may be printed on a game piece. For example, the game piece may be printed by a printer included in the lottery terminal. Alternatively, the set of game play data may be displayed on a display. The display may be included in the lottery terminal. If the displayed outcome were a winner, a game piece may be printed by the printer as a receipt.

In 1016, the player may compare the set of game play data with a prior set of game play data to ascertain the outcome of his chance. For example, the game piece may include a prior set of game play data. The prior set of game play data may have been generated when the player purchased a prior chance in the game. For example, the comparison may be matching graphics or numbers between the new set of game play data and the prior set of game play data. Alternatively, the comparison may be based on the value of a combination of cards indicated by the new set of game play data and the prior set of game play data. For example, the prior set of game play data and the new set of game play data may indicate a hand of cards in poker or blackjack. Alternatively, the comparison may be based on the value of a combination of game pieces indicated by the new set of game play data and the prior set of game play data in a board game.

If the outcome is winning, the player may proceed to redeem the game piece for a prize. In 1020, the game piece may be redeemed for a prize. For example, the player may redeem the game piece for one or more prizes at the lottery terminal or with an authorized lottery game representative or agent. If the outcome is losing, player may purchase another chance.

Figure 11:
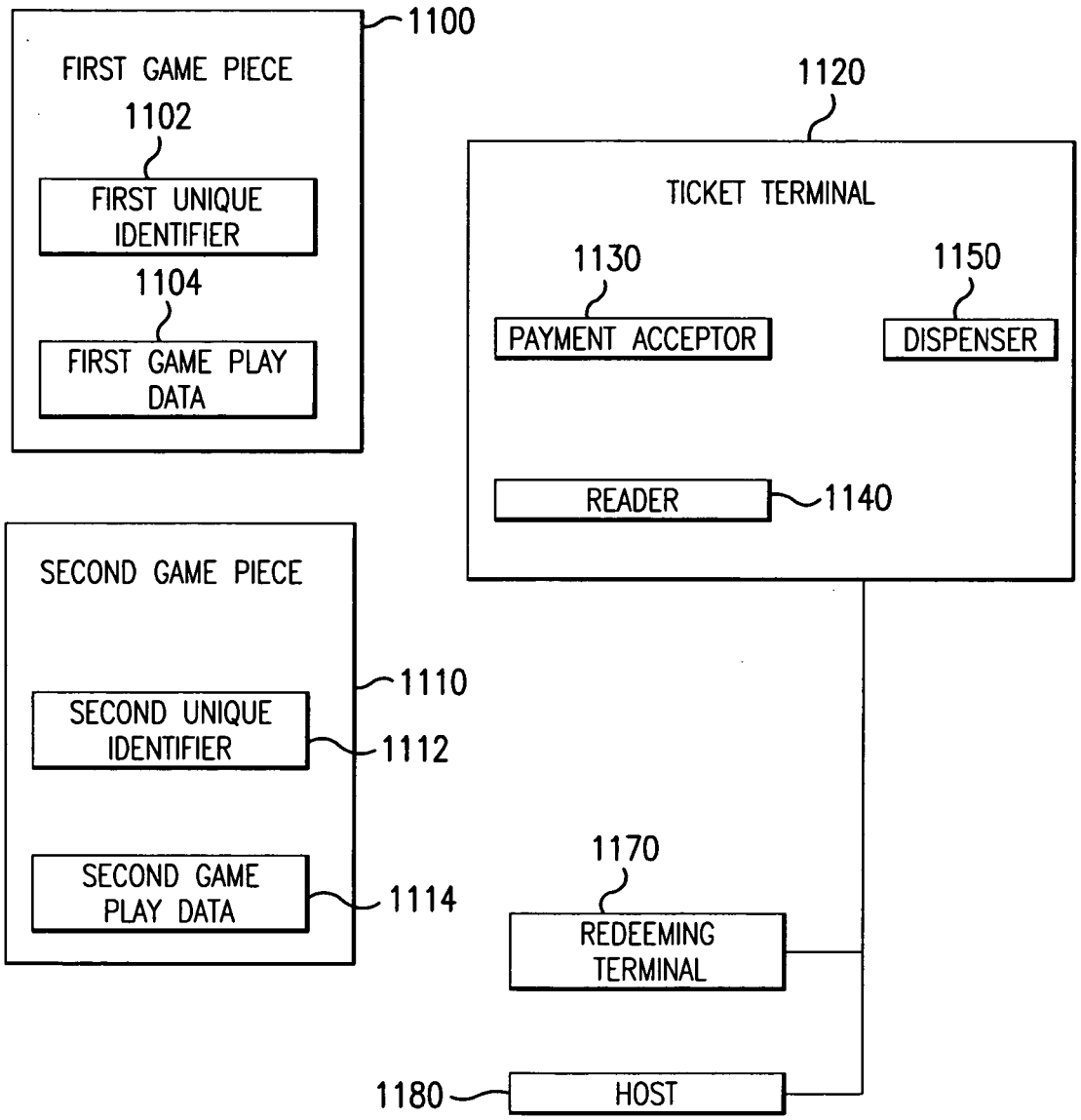
FIG. 11 illustrates an example of a system for conducting a lottery game, according to an example embodiment of the present invention.

FIG. 11 illustrates an example system for conducting a lottery game, according to an example embodiment of the present invention. A first game piece 1100 may be distributed to a player. The first game piece may be freely distributed as a promotion, or sold as part of the purchase of a chance in the game. For example, the first game piece 1100 may be printed on heavy paper or placed in a sealed envelope. The first game piece 1100 may include a first identifier 1102. The first identifier may identify the first game piece 1100. The first game piece 1100 may include a first set of game play data 1104. For example, the first set of game play data 1104 may include graphics and text. The first game pieces may be unique, or alternatively, multiple identical first game pieces may be part of the game.

A second game piece 1110 may be distributed to a player. For example, the second game piece 1110 may be printed on heavy paper or placed in a sealed envelope. The second game piece 1110 may include a second identifier 1112. The second identifier may identify the second game piece 1110. The second game piece 1110 may include a second set of game play data 1114. For example, the second set of game play data 1114 may include graphics and text. As previously described, the second set of game play data 1114 may be chosen based after the determination of a game outcome, so that a combination of the first game play data and second game play data can be used by a player to ascertain the same outcome.

A ticket terminal 1120 may include a payment accepter 1130, a reader 1140, and a dispenser 1150. For example, the payment acceptor 1130 may be configured to accept a payment. The payment may be, for example, cash, a credit card, a debit card, or a voucher. The payment acceptor 1130 may be configured to provide change for a cash payment.

The reader 1140 may be configured to read the first game piece 1100. In another example embodiment, the reader 1140 may be configured to read a machine-readable code included on the first game piece 1100. In another example embodiment, the reader 1140 may be configured to read a RFID tag included on the first game piece 1100. The game piece may be tendered for reading as part of a player's purchase of a chance in the game.

The dispenser 1150 may be configured to dispense the second game piece 1110. For example, the dispenser 1150 may include a printer to print the second game piece 1110. The ticket terminal 1120 and the redeeming terminal 1170 may be included in a lottery terminal within the same housing, or may be separate devices.

The ticket terminal 1120 and the redeeming terminal 1170 may be in communication with a host 1180. The host 1180 may contain game data, for example, past purchases by the player and a prize pool for the lottery game.

Figure 12:
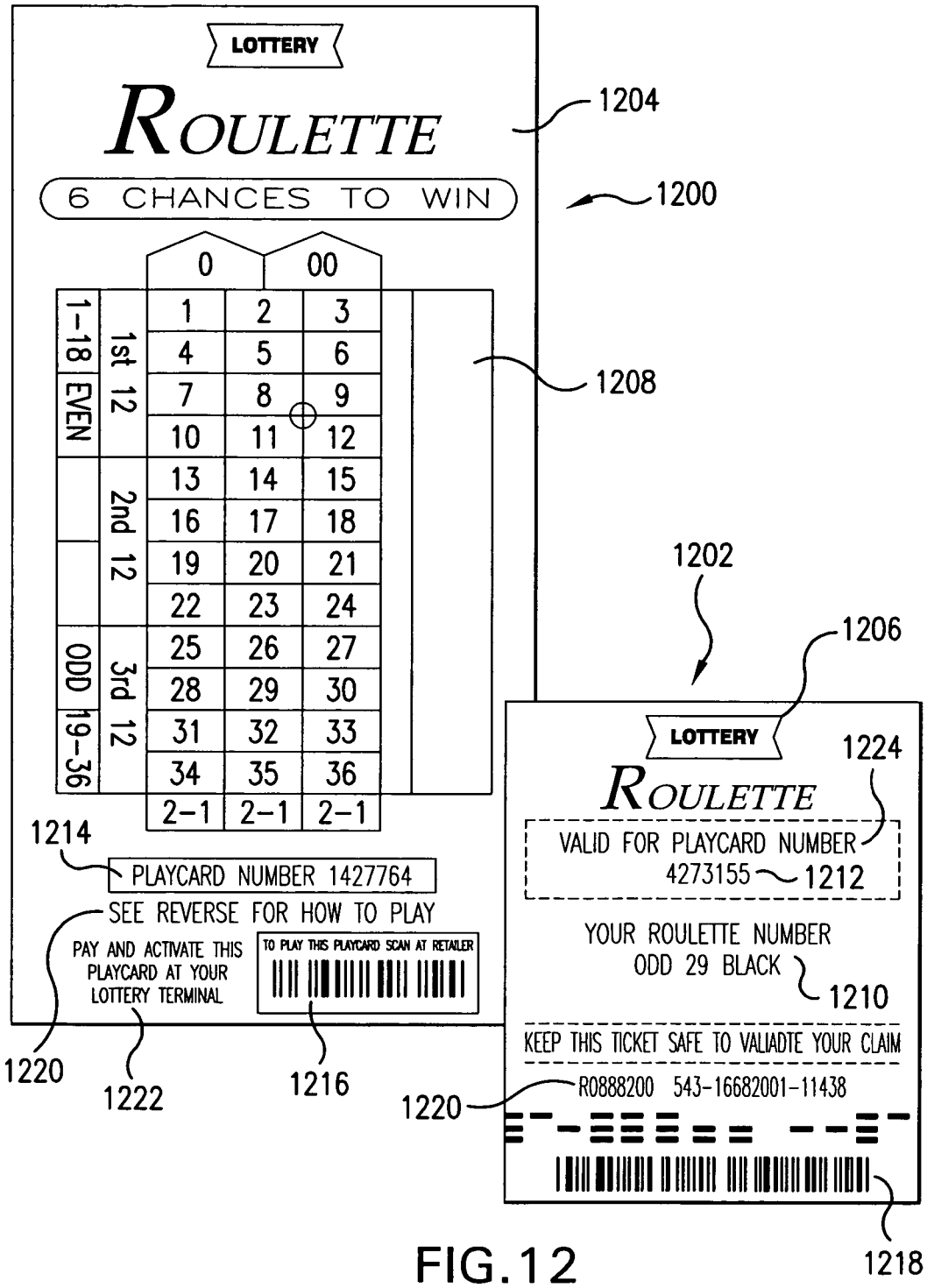
FIG. 12 illustrates another pair of example game pieces, according to another example embodiment of the present invention.

FIG. 12 illustrates another pair of example game pieces, according to another example embodiment of the present invention. A first game piece 1200 and a second game piece 1202 may be provided in a lottery game. For example, the first game piece 1200 may be a pre-printed paper slip, which may be freely distributed as a promotion. Alternatively, the first game piece 1200 may be sold from a retail store location or an automated kiosk.

The first game piece 1200 may include a first identifier 1214. For example, the first identifier 1214 may be a unique number, a unique sequence of characters, machine readable code, or an RFID tag. The first game piece 1200 may include graphics 1204. For example, the graphics 1204 may be the title of a lottery game, a logo, or visually attractive graphics.

The first game piece 1200 may include a first game data 1208. For example, the first game data 1208 may include a plurality of Roulette bets. The first set of game play data 1208 may also include a visual depiction of the Roulette bets on a Roulette layout.

The first game piece 1200 may include game play instructions 1220 and 1222. For example, the game play instructions 1220 and 1222 may instruct a player on how to play the game, describe the rules of the game, describe the prize structure of the game, or provide contact information of a lottery company.

The first game piece 1200 may include a machine readable code 1216. The machine readable code 1216 may represent the first identifier 1214. The machine readable code 1216 may be used to activate the first game piece after purchase by a player. For example, the machine readable code 1216 may be scanned at a lottery terminal or at a retail store location.

The second game piece 1202 may be distributed after the first game piece 1200 is activated. For example, the second game piece 1202 may be distributed by displaying it on a display, printing the game piece from a lottery terminal, or printing it on the first game piece 1200. For example, to print the second game piece 1202 on the first game piece, a player may insert the first game piece 1200 into a lottery terminal, where the first game piece 1200 is read and activated. A second game piece 1202 may then be printed on a portion of the first game piece 1200.

The second game piece 1202 may include a second play data 1210. The second play data 1210 may be a Roulette result. For example, the Roulette result may be an even/odd indicator, a number and a color. The Roulette result may be compared with the Roulette bets indicated by the first set of game play data 1208 to ascertain whether the player is a winner example in accordance with predetermined game rules.

The second game piece 1202 may include graphics 1206. For example, the graphics 1206 may be the title of a lottery game, a logo, or visually attractive graphics.

The second game piece 1202 may include game play instructions 1224. For example, the game play instructions 1224 may instruct a player on how to play the game, describe the rules of the game, describe the prize structure of the game, or provide contact information of a lottery company. The game play instructions 1224 may indicate that the second game piece 1202 is only valid for the first game piece 1200.

The second game piece 1202 may include the first identifier 1214. The first identifier 1214 may be depicted on the second game piece 1202 as in 1212. The second game piece 1202 may be only valid when compared with a particular associated first game piece 1200. This may be indicated by having a common identifier.

The second game piece 1202 may include a second unique identifier 1220. The second unique identifier 1220 may be associated with the first identifier 1214, e.g., by being identical to or containing a portion of the information from the first identifier 1214.

The second game piece 1202 may include a machine readable code 1218. The machine readable code 1218 may include information which represents the first identifier 1214. The machine readable code 1218 may also be used to ascertain a winning status of the second game piece 1202, e.g., when the game piece is presented for redemption. The machine readable code 1218 may alternatively represent a second unique identifier 1220.

Figure 13:
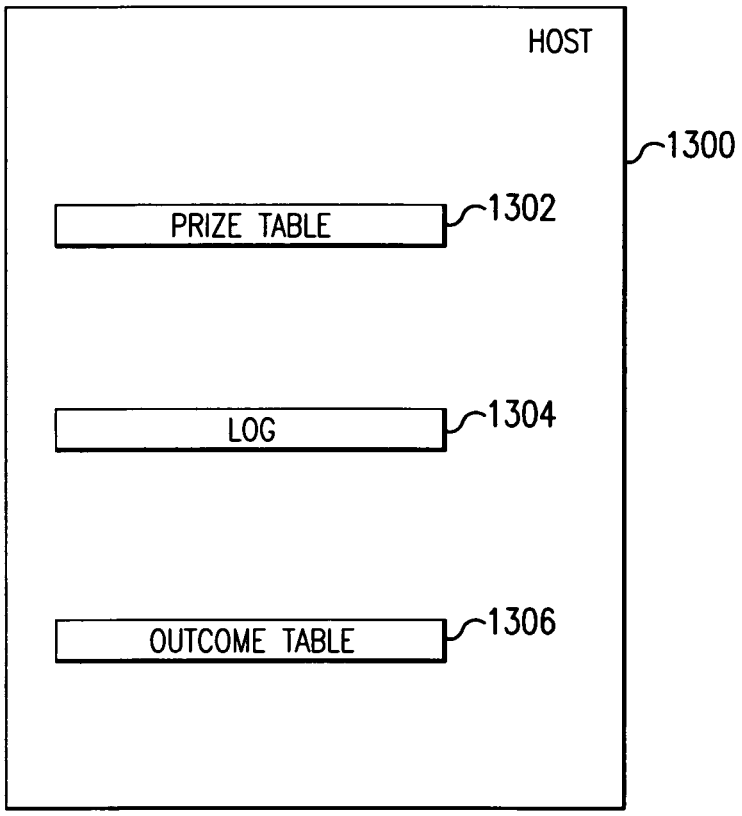
FIG. 13 illustrates an example data structure, according to an example embodiment of the present invention.

FIG. 13 illustrates an example data structure, according to an example embodiment of the present invention. A host 1300 may include a prize table 1302. For example, the prize table 1302 may include information about prizes available in a lottery game. Prizes available in a lottery game may be, for example, cash, additional lottery tickets for the same or different lottery game, or a voucher for goods or services redeemable at an authorized agent.

The prize table 1302 may be used by the host 1300 to select a prize to be awarded if the host 1300 decides a game piece's outcome is winning. If prizes are not replaced, the prize table 1302 may be updated to remove a prize after it has been awarded by the host 1300. The prize table 1302 may be updated by the host 1300 to add or remove prizes, for example, special bonuses or promotional prizes.

The host 1300 may include a log 1304. The log 1304 may record information, for example, game pieces purchased, game pieces activated, prizes awarded, a list of game pieces not to be activated or redeemed. A game piece may not be activated or redeemed if it was reported stolen or was a test game piece; this may be recorded in the log 1304. The log 1304 may be used for auditing purposes to ensure a specific payout percentage is achieved or to track players and their winnings.

The host 1300 may include an outcome table 1306. The outcome table 1306 may include a list of all game pieces in a lottery game. The outcome table 1306 may include a list of outputs, e.g., game play data to be printed to indicate a particular outcome, for various winning outcomes and losing outcomes associated with each game piece. The host 1300 may select one of the appropriate outputs from the outcome table 1306 after determining whether a game piece has a winning or losing outcome. The output may then be provided to a player. The player may compare the output with a set of game play data to ascertain whether the set of game play data is a winner.

Figure 14A:
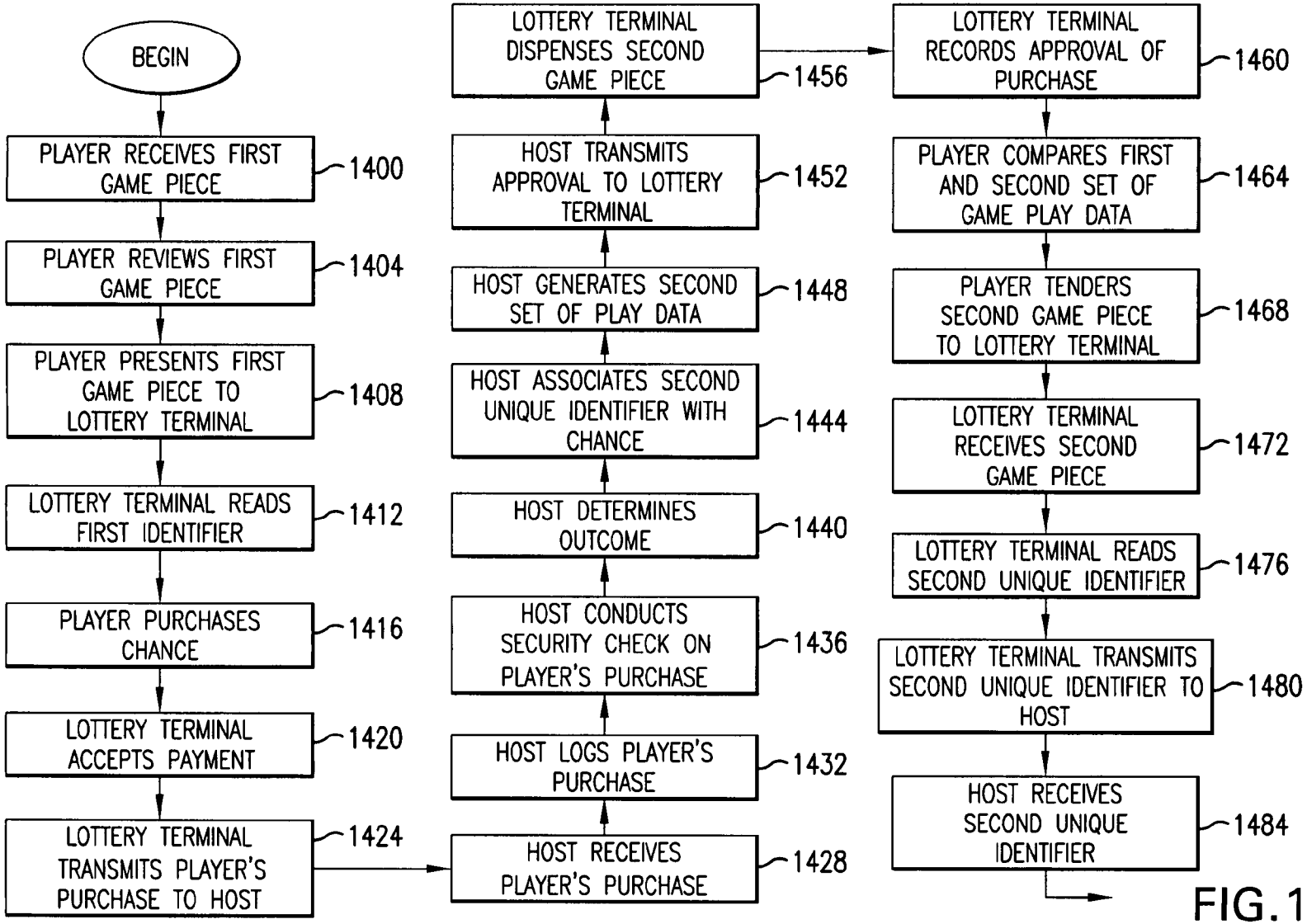
FIGS. 14A and 14B illustrate another example procedure for conducting a lottery game, according to another example embodiment of the present invention.

FIG. 14A illustrates another example procedure for conducting a lottery game, according to another example embodiment of the present invention. In 1400, a player may receive a first game piece. For example, the player may receive the first game piece at no cost, e.g., the first game piece may be mailed to the player as a promotion. Alternatively, the first game piece may be placed in a public location and made available to the player. Alternatively, the first game piece may be provided after the player provides identifying information. For example, the first game piece may be dispensed from a lottery terminal after the player enters identifying information. An example lottery terminal is depicted in FIG. 6. Identifying information may be, for example, a personal identifier, a valid credit card or debit card number, or a player's social security number.

In 1404, a player may review the first game piece. The first game piece may include rules of the lottery game. The first game piece may also contain a set of first game data. The first game piece may also include a first identifier. The first game piece may also contain a list of prizes available in the lottery game. The first game piece may be visually attractive. The first game piece may be printed in a manner to encourage the player to play the lottery game. After reviewing the first game piece, the player may decide to play the lottery game.

In 1408, the player may present the first game piece to a lottery terminal. The player may present the first game piece to the lottery terminal during a predetermined time frame. The predetermined time frame may be specified on the first game piece. For example, the first game piece may be encoded to be active during a certain period of time.

In 1412, the lottery terminal may read the first identifier from the first game piece. The lottery terminal may be configured to read the first identifier from the first game piece. Alternatively, the lottery terminal may be configured to read the first game piece in its entirety and extract the first identifier. Given the first identifier, stored information may be accessed to determine what game play data is on the first game piece, e.g., by checking a database. Alternatively, the lottery terminal may read the first game play data from the first game piece. The lottery terminal may verify that the first game piece is a valid game piece. The lottery terminal may verify that the first identifier is a valid first identifier.

In 1416, the player may purchase a chance from the lottery terminal. The lottery terminal may be placed on a retail store counter, operated by an attendant, integrated into a point of sales terminal, or an automated kiosk placed in a high traffic area.

The chance may be an opportunity to win a prize in a lottery game. The chance may also be associated with the player after purchase.

The player may be asked to provide personal information, for example, contact information and biographical information. Biographical information may be used, for example, for market research in future lottery games. The player's contact information may be used, for example, to send game information to the player. Game information may include, for example, reminders to play the lottery game, announcements of special prizes, and the player's possession of a possible winning chance. Alternatively, the chance may be anonymous, e.g., the bearer of a winning game piece can redeem it for a prize.

In 1420, the lottery terminal may accept a payment from the player. The lottery terminal may be configured to accept cash, credit cards, debit cards, vouchers, or other forms of payment. The lottery terminal may also be configured to authenticate cash, e.g., by using a conventional bill acceptor. The lottery terminal may also be configured to transmit a credit card or debit card purchase information to an appropriate authorization agency. The lottery terminal may also be configured to receive an authorization from the appropriate authorization agency. The lottery terminal may also be configured to authenticate a voucher by contacting a voucher authentication server or configured to authenticate a voucher.

In 1424, the lottery terminal may transmit information regarding the player's purchase to a host. The lottery terminal may also transmit the player's personal information. The lottery terminal may also transmit the first identifier. The lottery terminal may also transmit the first set of game data. The lottery terminal may also transmit the first game piece. The lottery terminal's transmissions may be encrypted. The lottery terminal's transmissions may be protected by other conventional security measures, e.g., the use of a secure network connection.

In 1428, the host may receive the transmitted information regarding a player's purchase. The host may also receive the player's personal information. The host may also receive the first identifier and/or the first set of game data. The host may also receive other information from the first game piece. The host may decrypt the lottery terminal's transmissions.

In 1432, the host may log the player's purchase. The host may also log the player's personal information. The host may also log the first identifier, the first set of game data and the first game piece.

The player's personal information may be used to implement a frequent player program. The frequent player program may reward a player who frequently plays the lottery game with prizes such as, for example, free lottery tickets or free merchandise. The frequent player program may have predetermined rules and prize levels for specified levels of play by the player. For example, the frequent player program may award the player a free lottery ticket after the player purchases 10 lottery-tickets.

In 1436, the host may conduct a security check on the player's purchase. For example, the host may check to see the player is not included on a do-not-play list. For example, a do-not-play list may be a voluntary list that players may join if they are problem gamblers. Alternatively, a do-no-play list may be a list of players banned from playing the lottery game, for example, players known to be cheaters in previous lottery games. The host may verify that the first game identifier is valid in the lottery game being played. The host may also verify that the first set of game data is valid in the lottery game being played. The host may approve the player's purchase. Alternatively, the host may deny the player's purchase.

In 1440, the host may determine an outcome for the chance. The outcome of the chance may be determined by sampling from a prize pool. Example methods of sampling are described in described in the U.S. Provisional Patent Application for a Flexible Online Instant Lottery Game (U.S. Patent Application 60/645,488, filed Jan. 18, 2005). The prize pool may be predetermined before the lottery game begins. The prize pool may alternatively carry over from one lottery game to another. The prize pool may alternatively be shared among different lottery games. The prize pool may be stored in a prize table on the host, e.g., in a database.

For example, sampling the prize pool may be random in nature. Alternatively, the sampling may be conducted in a predetermined order. For example, the host may award a prize for every third purchase. For example, the host may also vary the prize depending on how many purchases have been made, e.g., in the game, by the player, or at a particular location.

The outcome of the chance may be either losing or winning. A losing outcome may not provide a prize. A winning outcome may provide the player with one or more prizes from the prize pool. The prize pool may contain multiple types of prizes. Prizes may be monetary or non-monetary. Monetary prizes may be of different amounts of currency. Non-monetary prizes may include another chance in the lottery game or game merchandise. The prize pool may be restricted so that a predetermined number of prizes of each type are given out in a lottery game.

The prize pool may be predetermined. The prize pool may change after the outcome is determined, e.g., prizes may be awarded without replacement. The prize pool may be stored in memory as a prize table. The lottery terminal or the host may generate a random number and use the random number to select an entry from the prize pool.

In 1444, the host may associate a second unique identifier with the chance. For example, the second unique identifier may be stored in a temporary variable within the host. Alternatively, the second unique identifier may be stored in a database record along with other information regarding the chance.

For example, the second unique identifier may be generated so that it has a checksum number. The checksum number can be used in transmission verification or to verify the authenticity of a second unique identifier.

In 1448, the host may generate a second set of play data. The second set of play data may be generated so that a comparison of the first set of game play data and the second set of game play data indicates the outcome according to the predetermined game rules.

For example, the second set of game play data may be generated in accordance with the outcome. If the outcome is winning, the second set of game play data may be generated to form a winning combination with the first set of game play data.

If the outcome is losing, the second set of game play data may be generated to form a losing combination with the first set of game play data. The second set of game play data may be associated with the first set of game play data. The second set of game play data may be associated with the chance.

In 1452, the host may transmit an approval of the player's purchase to the lottery terminal. The host may transmit the second set of game play data to the lottery terminal. The host's transmissions may be encrypted. The host's transmissions may utilize other conventional security features, e.g., a secure network connection.

In 1456, the lottery terminal may dispense a second game piece. For example, the lottery terminal may print a second game piece including the second game play data. Alternatively, the lottery terminal may accept the first game piece from the player and print the second set of game play data on the first game piece. Alternatively, the lottery terminal may display the second set of game play data on a display attached to the lottery terminal.

The second game piece may be associated with the chance purchased by the player. The second game piece may include the second unique identifier.

In 1460, the lottery terminal may record the approval of the purchase. The lottery terminal may also record the amount and type of payment made by the player. The lottery terminal may also record any other information associated with the purchase. The lottery terminal may record the second game play data received from the host.

In 1464, the player may compare the first set of game play data and the second set of game play data. The player may utilize predetermined rules to ascertain whether the purchased chance is a winner by comparing the first set with the second set of game play data. For example, the comparison may be matching graphics or numbers between the first set of game play data and the second set of game play data. Alternatively, the comparison may be based on the value of a combination of cards indicated by the first set of game play data and the second set of game play data. For example, the first set of game play data and the second set of game play data may indicate a hand of cards in poker or blackjack. Alternatively, the comparison may be based on the value of a combination of game pieces indicated by the first set of game play data and the second set of game play data in a board game.

In 1468, the player may tender the second game piece for a prize. A player may redeem the game piece at a lottery terminal. A small cash prize and additional lottery tickets awarded as a prize may be redeemed at a lottery terminal, while a large cash prize may be redeemed by an authorized lottery game representative or agent, e.g., at a special redemption center. A game merchandise prize may also be redeemed by an authorized lottery game representative or agent.

In 1472, the lottery terminal may receive the second game piece. The player may be required to present proof of identification when tendering the second game piece. Proof of identification may, for example, be government issued identification such as a driver's license or a passport. Proof of identification may alternatively be a credit or debit card. The lottery terminal may include a card reader to read a player's proof of identification. The player's proof of identification may be compared with proof of identification stored when the player purchased the chance.

In 1476, the lottery terminal may receive the second unique identifier from the second game piece. For example, the lottery terminal may be configured to read the second unique identifier from the second game piece. The second unique identifier may be, for example, a RFID, a machine readable code, a smart card tag, or a magnetic stripe card. The second game piece may be returned to the player after the second unique identifier is read. Alternatively, the second game piece may be stored in the lottery terminal for later collection or destroyed.

In 1480, the lottery terminal may transmit the second unique identifier to the host. For example, the second unique identifier may be transmitted over a secure network. For example, the second unique identifier may also be transmitted in real time or batch/asynchronous mode to the host.

In 1484, the host may receive the second unique identifier from the lottery terminal. For example, the host may receive the second unique identifier from the lottery terminal over a secure network. The host may receive the second unique identifier from the lottery terminal in real time or in batch/asynchronous mode.

Figure 14B:
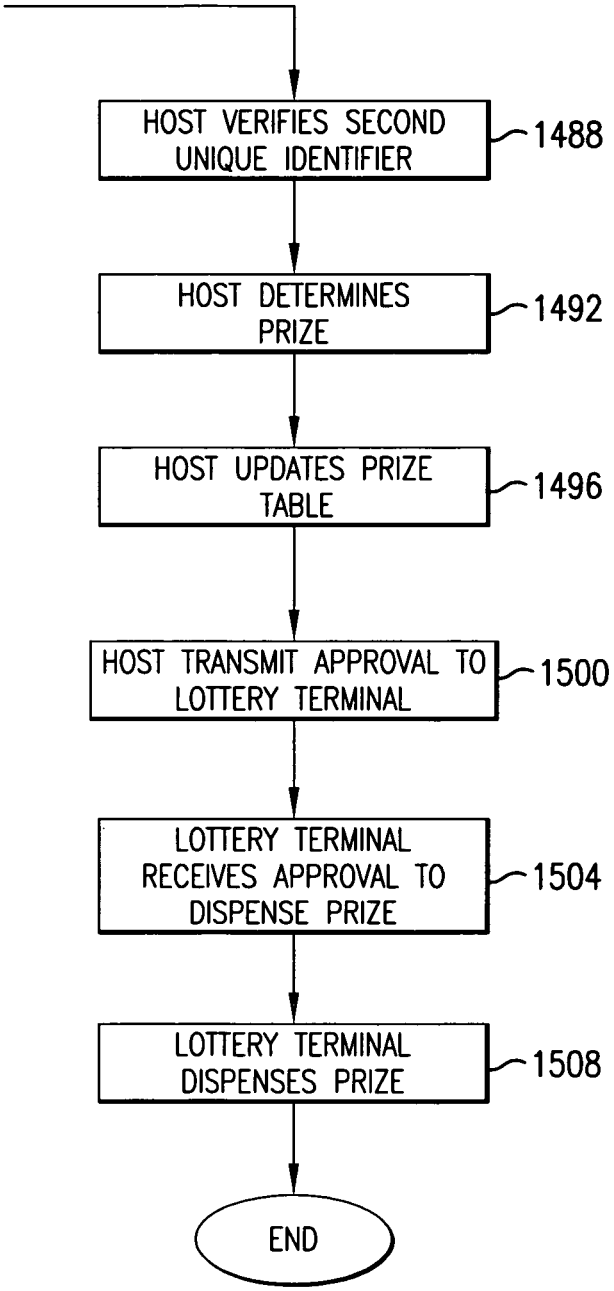

FIG. 14B illustrates more of the example procedure for conducting a lottery game, shown in FIG. 14A, according to an example embodiment of the present invention. FIG. 14B continues the example procedure from FIG. 14A. In 1488, the host may verify the second unique identifier. The host may, for example, check the log to verify the validity of the second unique identifier. The host may also, for example, check a list of second unique identifiers which have been flagged. A second unique identifier may be flagged if it is deactivated, was reported stolen, was associated a sample or a test game piece, or was previously redeemed.

The host may also verify the second unique identifier has a correct checksum. The checksum number can be used in transmission verification check for transmission errors or to verify the authenticity of a second unique identifier.

In 1492, the host may look up the prize from the prize table. For example, the host may check the prize table for the prize associated with the second unique identifier. For example, the host may verify that the second unique identifier is associated with a prize in the prize table. The host may also verify that the second unique identifier is associated with a prize that can be dispensed from a lottery terminal, and does not need to be diverted to a special redemption center.

In 1496, the host may update the prize table. For example, the host may record that the prize associated with the second unique identifier has been claimed. The prize table may be used for audit purposes and to determine which winning second unique identifiers have not been redeemed for a prize.

In 1500, the host may transmit approval to dispense the prize to lottery terminal. For example, the lottery terminal may be a kiosk, where the prize is dispensed automatically. For example, the lottery terminal may be operated by an agent of the lottery game. The approval may be transmitted to the lottery terminal and displayed for the agent of the lottery game. The host may also transmit information regarding the prize to be dispensed.

If the prize associated with the second unique identifier cannot be dispensed from the lottery terminal, an error message may be transmitted prompting the player to redeem the second game piece at an authorized agent of the lottery game. For example, if the prize associated with the second unique identifier is not authorized to be dispensed from the lottery terminal or the agent operating the lottery terminal, an error message may be transmitted prompting the player to redeem the second game piece at an authorized agent of the lottery game.

The approval may be accompanied by security flags and other security features to prevent interception and tampering during transmission. For example, the approval may be encrypted for security during transmission.

In 1504, the lottery terminal may receive the approval to dispense the prize associated with the second unique identifier. For example, the lottery terminal may verify the authenticity of the approval. For example, the lottery terminal may also parse the approval message for any error messages.

In 1508, the lottery terminal may dispense the prize associated with the second unique identifier. The lottery terminal may display a congratulatory message to the player and a description of the prize won by the player. The lottery terminal may print a prize voucher if it is unable to dispense the prize. For example, if the prize associated with the second unique identifier cannot be dispensed from the lottery terminal, an error message may be displayed prompting the player to redeem the second game piece at an authorized agent of the lottery game.

Modifications

In the preceding specification, the present invention has been described with reference to specific example embodiments thereof. It will, however, be evident that various modifications and changes may be made thereunto without departing from the broader spirit and scope of the present invention as set forth in the claims that follow. The specification and drawings are accordingly to be regarded in an illustrative rather than restrictive sense.

The invention claimed is:

1. A method of conducting a lottery game, comprising:

providing a player with a free pre-printed first game piece having a first set of game play data, wherein the first game play piece is insufficient to ascertain an outcome of the lottery game;

receiving information identifying the first game piece and an indication the player wishes to purchase a chance in the lottery game, the indication being payment in the form of a payment to a lottery terminal, the lottery terminal being configured to receive and authenticate the payment, the payment being received in a form selected from the group consisting of cash, credit card, debit card and voucher;

responsive to receiving the information and the indication, randomly determining an outcome for the chance;

choosing, with a processor, a second set of game play data based on the outcome and the first set of game play data, so that a comparison of the first set of game play data and the second set of game play data is indicative of the outcome of the chance according to predetermined game rules;

providing the player with a second game piece including the second set of game play data, data associating the second game piece with the first game piece, and a unique identifier;

receiving a claim for a prize from the player;

responsive to the claim for the prize, using the unique identifier to confirm whether the prize is due the player; and awarding the prize to the player, the value of the prize depending on the outcome.

2. The method of claim 1, further comprising;

providing the first game piece from a display at a point of sale terminal.

3. The method of claim 1. further comprising:

displaying a plurality of first game pieces with different game play data from which the player can choose the first game piece.

4. The method of claim 1, further comprising:

providing the first game piece as part of a mailing.

5. The method of claim 1, further comprising:

providing the first game piece as part of the completion of a purchase transaction for goods or services other than the lottery game.

6. The method of claim 1, further comprising:

including a first game piece identifier as part of the first game piece.

7. The method claim 6, wherein the first game piece identifier is unique.

8. The method of claim 6, wherein multiple first game pieces having the same game play data have the same first game piece identifier.

9. The method of claim 5, further comprising:

associating the first game piece identifier with the unique identifier in a database.

10. The method of claim 6, wherein the data associating the second. game piece with the first game piece includes the first game piece identifier.

11. The method of claim 6, further comprising:

receiving a tender of the first game piece as part of the player's request to purchase a chance in the lottery game; and responsive to receiving the tender of the first game piece, reading the first game piece identifier from the first game piece.

12. The method of claim 1, farther comprising:

receiving a tender of the second game piece as part of the claim for the prize; and responsive to receiving the tender of the second game piece, reading the unique identifier from the second game piece.

13. An article of manufacture comprising a non-transitory computer-readable medium having stored thereon instructions adapted to be executed by a processor, the instructions which, when executed by the processor, cause the processor to perform the method of conducting a lottery game comprising the Steps of providing a player with a free pre-printed first game piece having a first set of game play data, wherein the first game piece is insufficient to ascertain an outcome of the lottery game;

receiving information identifying the first game piece and an indication the player wishes to purchase a chance in the lottery game, the indication being payment in the form of a payment to a lottery terminal, the lottery terminal being configured to receive and authenticate the payment, the payment being received in a form selected from the group consisting of cash, credit card, debit card and voucher;

responsive to receiving the information and the indication, randomly determining an outcome for the chance;

choosing a second set of game play data based on the outcome and the first set of game play data, so that a comparison of the first set of game play data and the second set of game play data is indicative of the outcome of the chance according to predetermined game rules;

providing the player with a second game piece including the second set of game play data, data associating the second game piece with the first game piece, and a unique identifier;

receiving a claim for a prize from the player;

responsive to the claim for the prize, using the unique identifier to confirm whether the prize is due the player; and awarding the prize to the player, the value of the prize depending on the outcome.

14. A computer implemented method of conducting a lottery game, comprising:

providing a player with a first game piece having a first set of game play data, wherein, when the first game piece is provided, the first game piece is insufficient to ascertain an outcome of the lottery game;

receiving, an indication the player wishes to purchase a chance in the lottery game, the indication being payment in the form of a payment to a lottery terminal, the lottery terminal being configured to receive and authenticate the payment, the payment being received in a form selected from the group consisting of cash, credit card, debit card and voucher;

determining an outcome for the chance;

choosing, with a processor, a second set of game play data based on the first set of game play data and the outcome, so that a comparison of the first set of game play data and the second set of game play data is indicative of the outcome of the chance according to predetermined game rules:

providing the player the second set of game play data;

awarding a prize to the player, a value of the prize depending on the outcome.

15. The method of claim 14, further comprising: responsive to the receipt of the indication that the player wishes to purchase the chance in the lottery game, randomly determining the outcome of the chance.

16. The method of claim 14, comprising;

as part of the player's purchase of a chance in the lottery game, receiving a first game piece identifier from the first game piece.

17. The method of claim 16, further comprising:

as part of the player's purchase of a chance in the lottery game, reading the first game piece identifier from the first game piece.

18. An article of manufacture comprising a non-transitory computer-readable medium having stored thereon instructions adapted to he executed by a processor, the instructions which, when executed by the processor, cause the processor to perform a method to conduct a lottery game comprising the steps of:

providing a player with a first game piece having a first set of game play data, wherein, when the first game piece is provided, the first game piece is insufficient to ascertain an outcome of the lottery game;

receiving an indication the player wishes to purchase a chance in the lottery game, the indication being payment in the form of a payment to a lottery terminal, the lottery terminal being configured to receive and authenticate the payment, the payment being received in a for selected from the group consisting of cash, credit card, debit card and voucher;

determining an outcome for the chance;

choosing, with a processor, a second set of game play data based on the first set of game play data and the outcome, so that a comparison of the first set of game play data and the second set of game play data is indicative of the outcome of the chance according to predetermined game rules;

providing the player the second set of game play data; and awarding a prize to the player, a value of the prize depending on the outcome.

19. The method of claim 14, further comprising: freely distributing the first game piece to the player.

20. The method of claim 14, wherein the first game piece is pre-printed with the first set of game play data.

21. The method of claim 14, further comprising:

receiving the first game piece from the player;

printing the second set of game play data on the first game piece; and after the second set of game play data has been printed, returning the first game piece to the player.

22. The method of claim 14, further comprising:

receiving the first game piece from the player; and displaying the second set of game play data on a video display.

23. The method of claim 14, further comprising:

printing a second game piece showing the second set of game play data; and providing the second game piece to the player.

24. The method of claim 23, further comprising:

including a unique identifier on the second game piece; and associating in a database a first game piece identifier on the first game piece with the unique identifier.

25. The method of claim 23, further comprising;

receiving a tender of the second game piece for a prize.

26. The method of claim 23, further comprising:

printing an identifier from the first game piece on the second game piece.

27. The method of claim 14, further comprising:

receiving an indication the player wishes to purchase a supplemental chance in the lottery game;

determining a supplemental outcome for the supplemental chance; and providing the player a supplemental set of game play data such that a comparison of the first set of game play data and the second set of game play data and the supplemental set of game play data indicates the supplemental outcome according to the predetermined game rules.

28. The method of claim 27, further comprising;

printing the supplemental set of game play data on one of the first game piece or a second game piece including the second set of game play data.

29. The method of claim 27, further comprising;

providing a supplemental game piece having the supplemental set of game play data.

30. The method of claim 29, further comprising:

allowing the player to continue to purchase additional supplemental chances at least until the player has a winning outcome.

31. The method of claim 27, wherein the supplemental set of game play data is associated with a supplemental unique identifier.

32. The method of claim 31, further comprising:

providing a supplemental game piece to the player, the supplemental game piece including the supplemental set of game play data and the supplemental unique identifier.

33. The method of claim 14, further comprising:

including a first identifier on the first game piece; and associating the first identifier with the first set of game play data in a database.

34. The method of claim 14, further comprising:

determining the outcome by selecting a random entry from a prize pool.

35. The method of claim 14, wherein the first set of game play data represents a bingo card and the second set of game play data represents a set of bingo draw numbers.

36. The method of claim 14, wherein the first set of game play data is arranged in a grid and the second set of game play data indicates positions in the grid.

37. The method of claim 14, wherein the combination of the first set of game play data and the second set of game play data indicate a hand of cards in a card game, and the outcome is based on rank of the hand of cards in the card game.

38. The method of claim 37, wherein the card game is poker.

39. The method of claim 37, wherein the card game is blackjack.

40. The method of claim 14, further comprising:

entering the player in a future draw lottery game using at least one of the first game play data and the second game play data.

41. The method of claim 40, further comprising:

broadcasting a draw in the future draw lottery game;

awarding the player a prize which can be ascertained by comparing the results of the draw and at least one of the first game play data and the second game play data.

42. A lottery game system, comprising:

a plurality of freely distributed game pieces each having a respective first set of game play data and a respective first identifier code wherein each freely distributed game piece is insufficient to ascertain an outcome of the lottery game;

a terminal configured to receive a first identifier code from one of the plurality of freely distributed game pieces presented by a player and an indication that the player wishes to purchase a chance in the lottery game, the indication being payment in the form of a payment to a lottery terminal, the lottery terminal being configured to receive and authenticate the payment, the payment being received in a form selected from the group consisting of cash, credit card, debit card and voucher;

a host in communication with the terminal, the host configured to receive the first identifier code from the terminal, to determine a game outcome responsive to the request to play the lottery game, to choose a second set of game play data so that a combination of the respective first set of game play data from the one of the game pieces presented by the player and the second set of game play data indicates the game outcome in accordance with predetermined game rules, and to transmit a second set of game play data to the terminal;

an output device in communication with the terminal, the output device configured to provide the second set of game play data to the player; and a redemption station in communication with the host and configured to pay a prize to the player based on the outcome.

43. The lottery game system of claim 42. wherein the redemption station is part of the terminal.

44. The lottery game system of claim 42, wherein the output device is part of the terminal.

45. The lottery game system of claim 42, further comprising:

a second game piece printed by the output device, the second game piece including the second set of game play data.

46. The lottery game system of claim 45, wherein the output device is further configured to print a second unique identifier code on the second game piece.

47. The lottery game system of claim 45, wherein the output device includes a video display configured to display the second set of game play data.

48. The lottery game system of claim 47, wherein the redemption station is further configured to read the second unique identifier code from the second game piece and to transmit the second unique identifier to the host.

49. The lottery game system of claim 42, the redemption station is part of the terminal.

50. The lottery game system of claim 42, further comprising:

a database accessible to the host, the database containing a plurality of records, at least one of the plurality of records associating the first set of game play data, the second set of game play data, the second unique identifier, the game outcome.

51. The lottery game system of claim 42, wherein the terminal further comprises:

a payment acceptor configured to accept a payment; and a reader configured to read a first identifier code from the first game piece.

52. The lottery game system of claim 42, further comprising:

a prize pool stored at the host, the prize pool, containing information identifying a plurality of prizes available in the lottery game.

53. The lottery game system of claim 42, wherein the host is in real-time communication with the terminal and the redemption station.

54. The lottery game system of claim 42, wherein each first game piece in the plurality of freely distributed game pieces has a unique first identifier code.

55. The lottery game system of claim 42, wherein subsets of the plurality of freely distributed game pieces have both identical sets of game play data and identical identifier codes.

* * * * *